US011766101B2

(12) United States Patent
Ferrara et al.

(10) Patent No.: US 11,766,101 B2
(45) Date of Patent: Sep. 26, 2023

(54) PERSONAL PROTECTIVE COVERING DEVICE

(71) Applicants: Mark Ferrara, Stonington, CT (US); Carolyn Ferrara, Stonington, CT (US)

(72) Inventors: Mark Ferrara, Stonington, CT (US); Carolyn Ferrara, Stonington, CT (US); Elizabeth Stone Gammage, Conroe, TX (US)

(73) Assignee: Mark Ferrara, Stonington, CT (US)

( * ) Notice: Subject to any disclaimer, the term of this patent is extended or adjusted under 35 U.S.C. 154(b) by 551 days.

(21) Appl. No.: 16/918,215

(22) Filed: Jul. 1, 2020

(65) Prior Publication Data

US 2020/0329835 A1 Oct. 22, 2020

Related U.S. Application Data

(63) Continuation-in-part of application No. 15/568,382, filed as application No. PCT/US2016/028777 on Apr. 22, 2016, now abandoned.

(Continued)

(51) Int. Cl.

*A45B 15/00* (2006.01)
*A45B 25/20* (2006.01)

(Continued)

(52) U.S. Cl.

CPC ..... *A45B 15/00* (2013.01); *A45B 11/00* (2013.01); *A45B 25/20* (2013.01); *A45B 19/04* (2013.01)

(58) Field of Classification Search

CPC ..... E04H 15/28; A45B 15/00; A45B 19/04
See application file for complete search history.

(56) References Cited

U.S. PATENT DOCUMENTS 144,792 A 11/1873 Prentiss
373,378 A 11/1887 Rumrille (Continued)

FOREIGN PATENT DOCUMENTS

CN 2719078 8/2005
CN 200994492 12/2007

(Continued)

OTHER PUBLICATIONS avso.org, 19 funny umbrellas that can brighten up any rainy day, Dec. 16, 2015, 2 pgs http://www.avso.org/interior-design-ideas/19-funny-umbrellas-that-can-brighten-any-rainy day.

(Continued)

*Primary Examiner* — Noah Chandler Hawk
(74) *Attorney, Agent, or Firm* — Womble Bond Dickinson (US) LLP

(57) ABSTRACT

A protective device configured to provide a user with body protection includes an umbrella having a canopy and a centrally positioned shaft extending from a center of the canopy. The shaft includes a telescopic stem configured to support the protective device when configured in its extended position. A plurality of umbrella spines extends from the centrally positioned shaft in a radial direction from the center of the canopy. Each umbrella spine has a proximate end originating adjacent the centrally positioned shaft and a distal end spaced apart from and opposite the proximate end. The distal end houses a telescoping rigid segment that is configured for radial extension from the distal end. The protective device further includes a protective member extending from a peripheral edge of the canopy. According to an aspect, the rigid segment is configured to support the protective member in the radially extended position.

19 Claims, 18 Drawing Sheets

Related U.S. Application Data

(60) Provisional application No. 62/302,607, filed on Mar. 2, 2016, provisional application No. 62/151,699, filed on Apr. 23, 2015.

(51) Int. Cl.
*A45B 11/00* (2006.01)
*A45B 19/04* (2006.01)

(56) References Cited

U.S. PATENT DOCUMENTS

| | | | | |
|---|---|---|---|---|
| 574,091 | A | 12/1896 | Irvine, Jr. | |
| 941,458 | A * | 11/1909 | Leach | E04H 15/28 135/114 |
| 1,774,909 | A | 9/1930 | Wells | |
| 1,854,671 | A | 4/1932 | Roberts | |
| 2,146,517 | A * | 2/1939 | Thompson | E04H 15/28 135/120.1 |
| 2,221,366 | A | 11/1940 | Bisbing et al. | |
| 2,502,984 | A | 4/1950 | Helen | |
| 2,546,228 | A | 3/1951 | Ferruccio | |
| 2,873,750 | A * | 2/1959 | McCarthy | E04H 15/28 135/120.3 |
| 3,407,825 | A | 10/1968 | Doyle | |
| 3,879,086 | A | 4/1975 | Moceri | |
| 3,899,168 | A | 8/1975 | Besherse | |
| 4,022,233 | A | 5/1977 | Grundman | |
| 4,202,363 | A | 5/1980 | Watts et al. | |
| 4,364,193 | A | 12/1982 | Visco | |
| 4,449,542 | A | 5/1984 | McSwain et al. | |
| 5,121,703 | A | 6/1992 | Smith | |
| 5,172,712 | A | 12/1992 | Robinson | |
| 5,287,872 | A | 2/1994 | Anderson | |
| 5,664,595 | A | 9/1997 | Vonderhorst et al. | |
| 5,806,547 | A | 9/1998 | Derlinga | |
| 5,823,212 | A | 10/1998 | Allen | |
| 5,890,506 | A | 4/1999 | Kupferman | |
| 7,004,539 | B1 | 2/2006 | Hansen et al. | |
| 7,431,389 | B2 | 10/2008 | Reeb et al. | |
| 7,434,591 | B2 | 10/2008 | Church | |
| 8,091,962 | B2 | 1/2012 | Quinn | |
| 8,997,770 | B1 | 4/2015 | Martin | |
| 9,057,206 | B2 | 6/2015 | Lin | |
| 9,072,290 | B1 | 7/2015 | McCauley | |
| 9,462,860 | B1 | 10/2016 | Whetstone | |
| 9,603,423 | B1 * | 3/2017 | Skobeleva | A45B 15/00 |
| 9,795,526 | B2 | 10/2017 | Davis | |
| 9,924,768 | B1 | 3/2018 | Rosenberger et al. | |
| 9,932,752 | B1 | 4/2018 | Vila | |
| 10,161,158 | B2 | 12/2018 | Mummert | |
| 10,238,192 | B2 | 3/2019 | Khan | |
| 2002/0134416 | A1 | 9/2002 | Feldpausch et al. | |
| 2004/0079406 | A1 | 4/2004 | Byun | |
| 2004/0222678 | A1 | 11/2004 | Hansen | |
| 2004/0238021 | A1 | 12/2004 | Holub et al. | |
| 2005/0011134 | A1 * | 1/2005 | Boltan | E04H 15/003 52/3 |
| 2005/0028451 | A1 | 2/2005 | Knoepp | |
| 2005/0103372 | A1 | 5/2005 | Dubinsky-Witkowski | |
| 2006/0005871 | A1 | 1/2006 | Church | |
| 2007/0125409 | A1 | 6/2007 | Cullen | |
| 2007/0251557 | A1 | 11/2007 | Carter et al. | |
| 2010/0258151 | A1 | 10/2010 | Vogt | |
| 2011/0240073 | A1 | 10/2011 | Reid | |
| 2013/0061897 | A1 | 3/2013 | Webster et al. | |
| 2017/0112244 | A1 | 4/2017 | Viscogliosi, Jr. | |
| 2018/0140060 | A1 * | 5/2018 | Ferrara | A45B 23/00 |

FOREIGN PATENT DOCUMENTS

| | | | |
|---|---|---|---|
| CN | 201256678 | | 6/2009 |
| CN | 201319928 | | 10/2009 |
| CN | 201414510 | | 3/2010 |
| CN | 202077727 | U | 12/2011 |
| CN | 202456825 | U | 10/2012 |
| CN | 203234164 | U | 10/2013 |
| CN | 104337631 | A | 2/2015 |
| CN | 107259735 | B | 10/2017 |
| GB | 1524515 | A | 9/1978 |
| GB | 2482279 | A | 2/2012 |
| JP | 2002125731 | A | 5/2002 |
| NL | 1004754 | C1 | 6/1998 |

OTHER PUBLICATIONS

EP Search Report and Opinion of EP16783909.1, which is in the same family as International Application No. PCT/US2016/28777, dated Oct. 29, 2018, 10 pages.

International Search Report and Written Opinion of International Application No. PCT/US2016/028777, dated Apr. 22, 2016, 11 pgs.

Modern Mechanix, Windshield Folds Inside Umbrella (May 1936), Jun. 16, 2013, 1 page, http://blog.modernmechanix.com/windshield-folds-inside-umbrella/.

Splash Innovations, 4 X Boxes of 6—Bivvy Brolly by Rob McAlister, Jun. 18, 2018,4 pgs., https://www.splashinnovations.com/full-boxes-umbrellas/4-boxes-bivvy-brolly.

Splash Innovations, Fishing Umbrella, Dec. 16, 2015, 2 pgs, http://www.splashinnovations.com/sports-golf-umbrellas/fishing-rob-mcalister-umbrella.

Splash Innovations, Shelta-Shade Garden Parasol with Windbreak, 3 pgs., https://www.splashinnovations.com/sun-umbrellas/shelta-shade-sun-umbrella-with-windbreak.

sport-brella.com, Sport-Brella Chair, Jun. 27, 2010, 1 page, http://www.sport-brella.com/sport-brella-chair.

United States Patent and Trademark Office, Office Action of U.S. Appl. No. 15/568,382, dated Jan. 10, 2019, 18 pgs.

United States Patent and Trademark Office, Office Action of U.S. Appl. No. 15/568,382, dated Jul. 29, 2019, 20pgs.

United States Patent and Trademark Office, Office Action of U.S. Appl. No. 15/568,382, dated Mar. 5, 2020, 20 pgs.

walmart.com, Pure Garden Outdoor Umbrella Screen, Black, Oct. 13, 2014, 1 page, https://www.walmart.com/ip/Pure-Garden-Outdoor-Umbrella-Screen-Black/38065348.

* cited by examiner

PERSONAL PROTECTIVE COVERING DEVICE

CROSS-REFERENCE TO RELATED APPLICATIONS

This application is a Continuation-in-Part patent application of U.S. patent application Ser. No. 15/568,382 filed Oct. 20, 2017, which is a national phase application of and claims priority to PCT/US2016/028,777 filed Apr. 22, 2016, which claims the benefit of U.S. Provisional Patent Application No. 62/151,699 filed Apr. 23, 2015, and U.S. Provisional Patent Application No. 62/302,607 filed Mar. 2, 2016, each of which is incorporated herein by reference in its entirety.

FIELD

A device and a method for providing protection against weather elements is generally described. More specifically, a portable protective device for providing a user with full body protection against weather elements is described.

BACKGROUND

Known techniques and devices for providing protection against weather elements, such as rain, snow, hail and sleet, include conventional umbrellas and wearable rain protection garments, such as, raincoats. Conventional umbrellas generally include a pole, ribs/spines radially connected to the top portion of the pole, and a canopy attached to the ribs. The pole is often configured to be strong enough to withstand the weight of the ribs and the canopy. Although conventional umbrellas may provide some protection from weather elements, they may only provide protection from straight-falling rain and/or snow and the protection may only be for the top third of a user's body. This often means that a large portion of the user's body and/or items being transported by the user such as, for example, a baby, as for instance a baby being carried in a harness, and/or packages, shopping bags, purses, backpacks, and other valuable items, may remain exposed and/or vulnerable to weather elements and may be exposed to splashing of rain, sleet and/or snow caused by moving vehicles. Moreover, conventional umbrellas may fail to protect users from heavy rain, snow or hail or sleet, particularly when coupled with wind and rain being driven sideways by the wind. In these situations, wind coupled with snow, hail and/or sleet may result in the user's lower body becoming wet. This often results with the user having to walk, stand, or sit with uncomfortably moist or wet clothes, which is at least uncomfortable. In addition, because the underside of the canopies of umbrellas have increased surface areas, in windy conditions, the wind may create a force that pulls and/or lifts the canopy away from the user and in the direction of the wind, which may result in the user having to struggle to maintain control of the umbrella. This may cause a large portion of the user's body, including the top portion and/or items being transported by the user, to become wet.

To help alleviate some of the issues often experienced with umbrellas, raincoats are often used. Conventional raincoats are usually provided in generic sizes, such as small, medium, large and extra-large, and are wearable over the user's clothing. One downfall of conventional raincoats is that they may be usable only for a limited time, at least in part because the user's size may change from, for example, a small to a medium. In other words, the protection that a raincoat may provide may only last for so long as the user is the same size. Raincoats may need to be replaced if they no longer fit the user. In addition, conventional raincoats may fail to provide adequate protection for the user, particularly if the user is transporting items that they cannot fit on their person, such as, for example, shopping bags, purses, paper materials, food, and/or drinks. Moreover, because raincoats may serve to provide protection from a user getting wet, they may often be made of heavy and waterproof materials that limit the exchange of air between the outside and inside of the raincoat. This may result in the user becoming hot and/or causing the user to perspire.

FIG. 1 illustrates a prior art umbrella 1 for use against weather elements. The umbrella 1 includes a vertical attachment shield 2 extending from the umbrella 1. The umbrella 1 includes a canopy 3 and spines 4 radially extended from a central portion of the canopy 3. The vertical attachment shield 2 appears to be a continuous sheet of clear material extending from the canopy 3 of the umbrella 1 towards the ground, such that vertical attachment shield 2 surrounds a user's body. One downfall with this umbrella, is that it may only provide protection to personal items the user may carry on their person, i.e., items that may be attachable to the user's body. The umbrella 1 does not appear to provide any sort of access for ease of entry and/or exit therefrom. Further, the umbrella 1 does not appear to provide any sort of ventilation, meaning that normal breathing and/or humidity will likely condensate on the inside of the vertical attachment shield 2 and impair the user's ability to see through the vertical attachment shield 2. In addition, while it is not readily apparent how the vertical attachment shield 2 is attached to the canopy 3, there does not appear to be any sort of detachability for ease of use of the umbrella 1 without the vertical attachment shield 2.

The aforementioned techniques and devices for providing protection may not provide full body protection against weather elements, may fail to provide adequate ventilation while in use, and may not provide a customized fit for an individual user.

In view of the disadvantages associated with currently available methods and devices for protection against weather elements, there is a need for a device and method that provides full body protection against the weather elements, protecting a user's clothing and anything being carried by the user so that they will remain clean, safe and/or dry, while also providing a customizable fit for an individual user. Further, there is a need for a protection device that provides all-around water resistance and ventilation for the individual user, while also being versatile enough to be retrofit to standard umbrellas of all shapes and/or sizes. In addition, there is a need for a protective device that is easily stored and/or transportable, without requiring assembly of multiple components.

BRIEF DESCRIPTION

According to an aspect, the present embodiments may be associated with a protective device configured to provide a user with body protection. The protective device includes an umbrella having a canopy and a centrally positioned shaft extending from a center of the canopy. The shaft includes a telescopic stem configured to support the protective device when configured in its extended position. A plurality of umbrella spines extend from the centrally positioned shaft in a radial direction from the center of the canopy. According to an aspect, each umbrella spine has a proximate end originating adjacent the centrally positioned shaft and a distal end spaced apart from and opposite the proximate end.

The distal end houses a telescoping rigid segment that is configured for radial extension from the distal end. The protective device further includes a protective member extending from a peripheral edge of the canopy. According to an aspect, the rigid segment is configured to support the protective member in the radially extended position.

Embodiments of the disclosure may further be associated with a protection device configured for providing a user with body protection. The protective device includes an umbrella having a canopy and a centrally positioned shaft, as well as a protective member extending from a peripheral edge of the canopy. The shaft may include a telescopic stem configured to support the protective device when configured in its extended position. A plurality of umbrella spines extend from the centrally positioned shaft in a radial direction from the center of the canopy. Each umbrella spine has a proximate end originating adjacent the centrally positioned shaft and a distal end spaced apart from and opposite the proximate end. According to an aspect, the distal end houses a telescoping rigid segment configured for radial extension from the distal end to support the protective member in the radially extended position.

BRIEF DESCRIPTION OF THE FIGURES

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1:
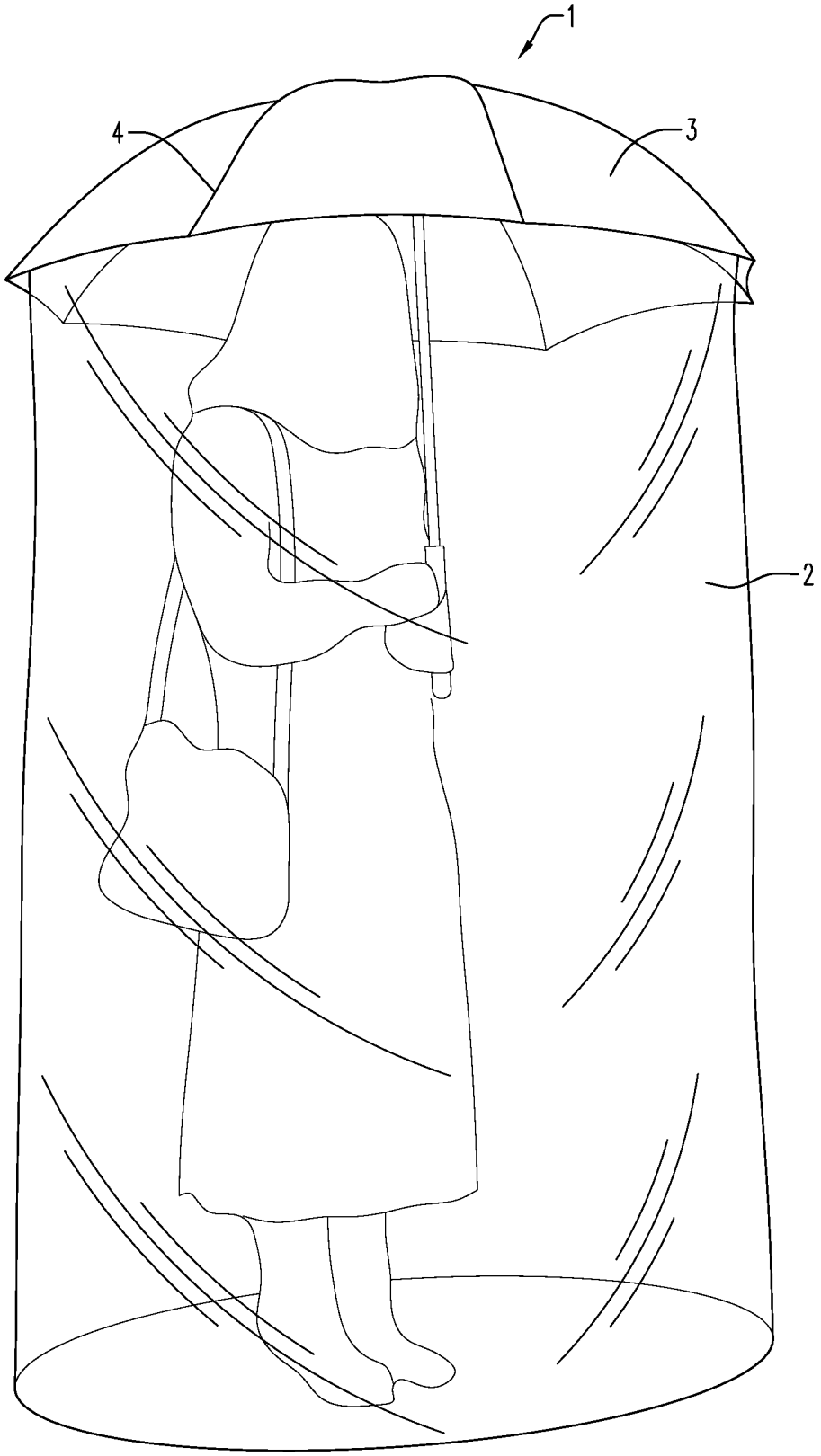
FIG. 1 (PRIOR ART)
FIG. 1 is a perspective view of a full body protection umbrella according to the prior art.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.

DETAILED DESCRIPTION

Reference will now be made in detail to various embodiments. Each example is provided by way of explanation, and is not meant as a limitation and does not constitute a definition of all possible embodiments.

Embodiments of the disclosure relate generally to devices and methods for providing full-body protection against weather elements. Such devices provide particular utility in providing a full-body protection against weather elements, such as, rain, snow, sleet, hail, wind, sun, etc. According to an aspect, the devices contemplated can be a protective covering that can be retro-fitted to a standard umbrella and provide a user with full-body protection from weather elements. In such an embodiment, the protective covering may include a covering member configured for positioning over an umbrella and a protective member extending from the covering member, and typically extending a sufficient length to cover at least a portion of the body of the user. In an embodiment, the canopy opens like a conventional umbrella and the protective member may be lowered to provide protection to the user. At least a portion of the protective member is substantially see-through and is composed of an impervious waterproof material. The protective covering may be configured to slip over and at least partially cover the umbrella.

Further, embodiments contemplated relate to a protective device configured for providing a user with full body protection against weather elements. The protective device includes an umbrella, such as a collapsible, foldable umbrella, having a canopy and a shaft extending substantially from a center of the canopy. The shaft may include a telescopic stem configured for extension to a support structure and to support the protective device when configured in its extended position. Thus, the protective device is capable of providing full body protection against weather elements and stand freely, such that the user does not have to manually hold the protective device. The protective device may include a protective member extending from a peripheral edge of the canopy. According to an aspect, at least a portion of the protective member is substantially see-through and is composed of an impervious waterproof material.

Embodiments contemplated further include a portable protective device that is configured for providing a seated user with full body protection against weather elements. The portable protective device may include a collapsible chair, an umbrella attachable to a collapsible chair and a protective member attached to the umbrella.

For purposes of illustrating features of the embodiments, a simple example will now be introduced and referenced throughout the disclosure. Those skilled in the art will recognize that this example is illustrative and not limiting and is provided purely for explanatory purposes.

Figure 2:
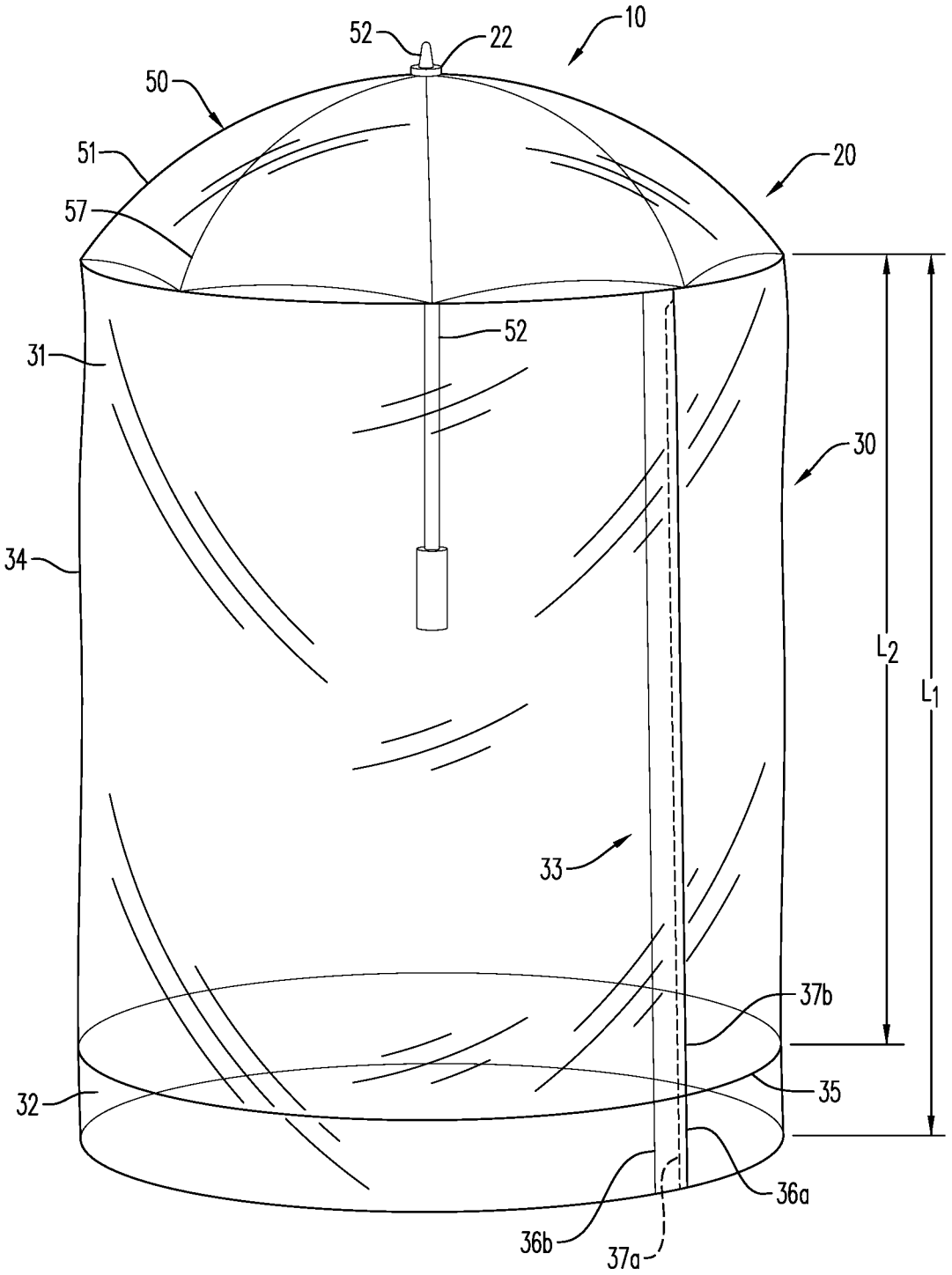
FIG. 2 is a side, perspective view of a retro-fit protective covering according to an embodiment.
Figure 3:
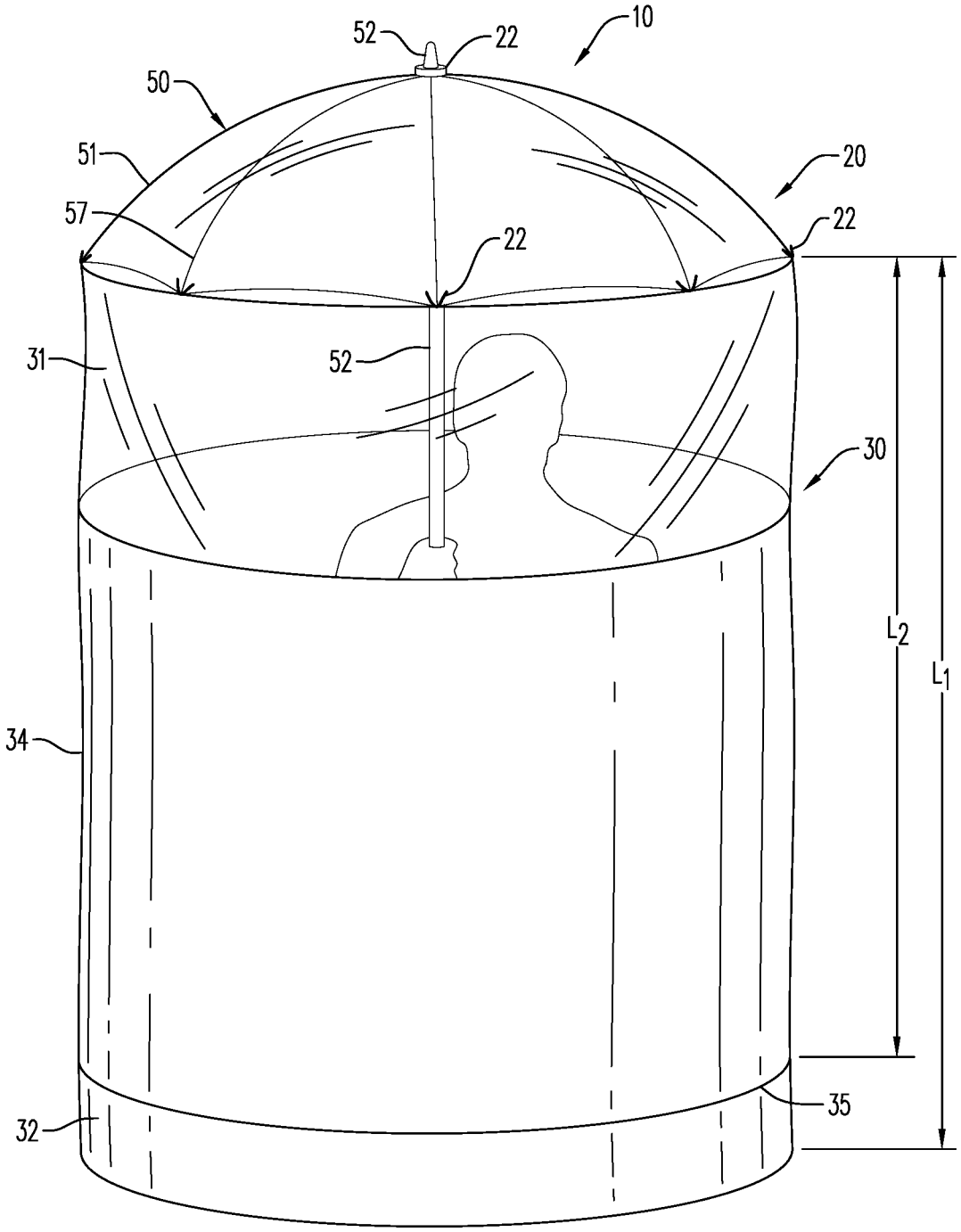
FIG. 3 is a side, perspective view of a retro-fit protective covering according to an embodiment, illustrating the retro-fit protective covering in use.

In an embodiment and with particular reference to FIGS. 2-3, a protective covering 10 configured to slip over and at least partially cover an umbrella 50 to provide a user with full body protection against weather elements is illustrated. According to an aspect, the protective covering 10 is adapted for retrofitting to the umbrella 50. The protective covering 10 may include a covering member 20 configured for positioning over a canopy 51 of the umbrella 50 and a protective member 30 extending from the covering member 20.

In an embodiment, the covering member 20 includes one or more attachment members 22 configured to at least temporarily couple the covering member 20 to the umbrella 50. The attachment members 22 may extend from an interior surface of the covering member 20 and may be positioned at one or more positions to attach to the umbrella 50. As illustrated in FIG. 2, one attachment member 22 may be positioned adjacent to a center post and/or shaft 52 of the umbrella 50. In some embodiments and as illustrated in FIG. 3, additional attachment members 22 may be positioned adjacent to an end opposite of the shaft 52, such as on one or more spines 57 of the umbrella 50. It is to be understood that the attachment members 22 may be positioned at any position on the umbrella 50 that is able to tether the covering member 20 thereon. For instance, in an embodiment, the attachment members 22 may be positioned on the covering member 20 for attachment to one or more ends of the spines 57 of the umbrella 50. According to an aspect, the attachment members 22 include an elastic portion configured to cinch or otherwise elastically engage the umbrella 50. In an embodiment, such elasticity will prevent water from seeping under the covering member 20, between the covering member 20 and the waterproof canopy 51. The attachment members 22 may be bungee loops, tie downs or any other means configured to at least temporarily secure the covering member 20 to the canopy 51. The attachment members 22 may be attached or otherwise coupled to the umbrella 50, when the umbrella 50 is in a collapsed and folded position. According to an aspect, the attachment members 22 are accessible while the canopy 51 is in a substantially upright and open position, such that the user can secure the covering member 20 to the canopy 51 without the user being exposed to weather elements.

According to an aspect, the covering member 20 is capable of being positioned over the canopy 51 of the umbrella 50. The covering member 20 may be of any shape, including, but not limited to circular, rectangular, octagonal and square. In some configurations, the covering member 20 is adjustable to a shape of the canopy 51 by virtue of being coupled to, for example, the spines 57 of the umbrella. In some embodiment, the covering member 20 is sized to fit canopies 51 of standard umbrella 50 sizes, such as, for example, small, medium, large and extra-large. The covering member 20 may include at least one of canvas or plastic sheeting or film, including but not limited to nylon, polyester, polyethylene terephthalate (PET), polyethylene (high or low density), polycarbonate, polyvinyl chloride (PVC), vinyl, acrylic and the like, including transparent, semi-transparent and/or non-transparent materials made thereof. The covering member 20 may include a waterproof material that is substantially the same as the material of the canopy 51 of the umbrella 50.

Figure 7:
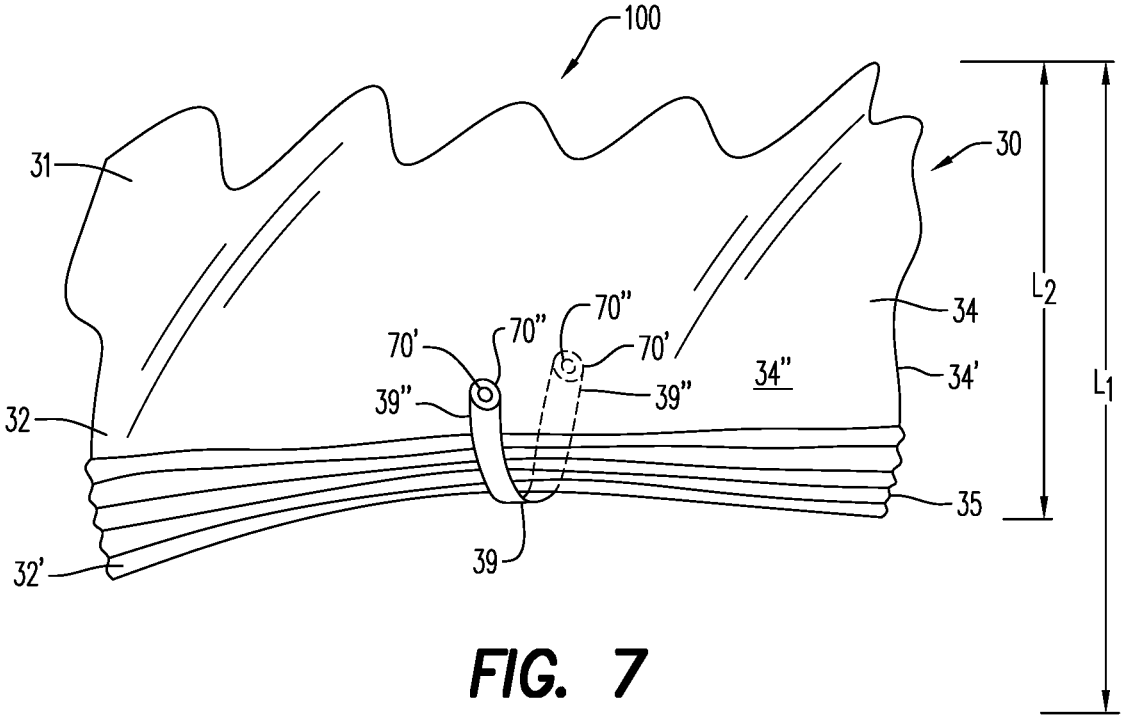
FIG. 7 is a side view of a protective device according to an embodiment, illustrating an adjustable length.
Figure 8:
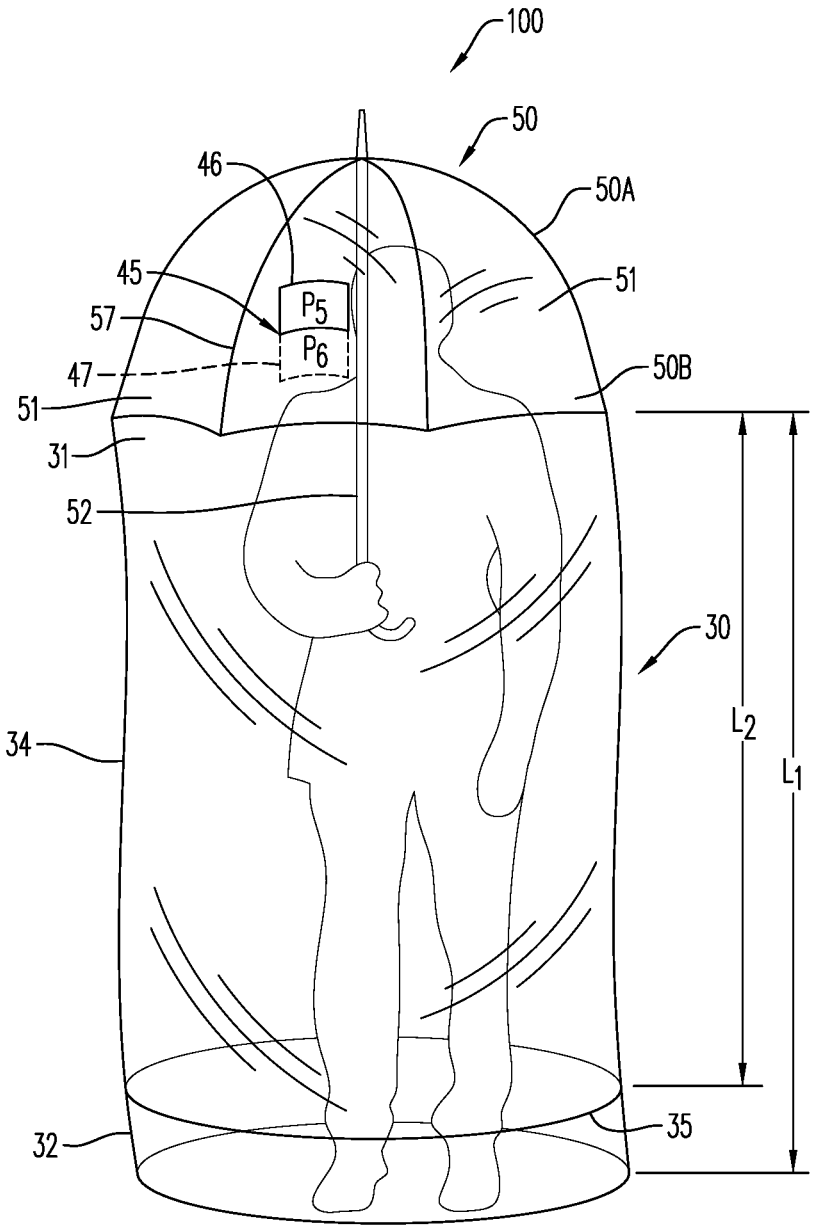
FIG. 8 is a perspective view of a protective device according to an embodiment, illustrating the protective device in use.
Figure 9:
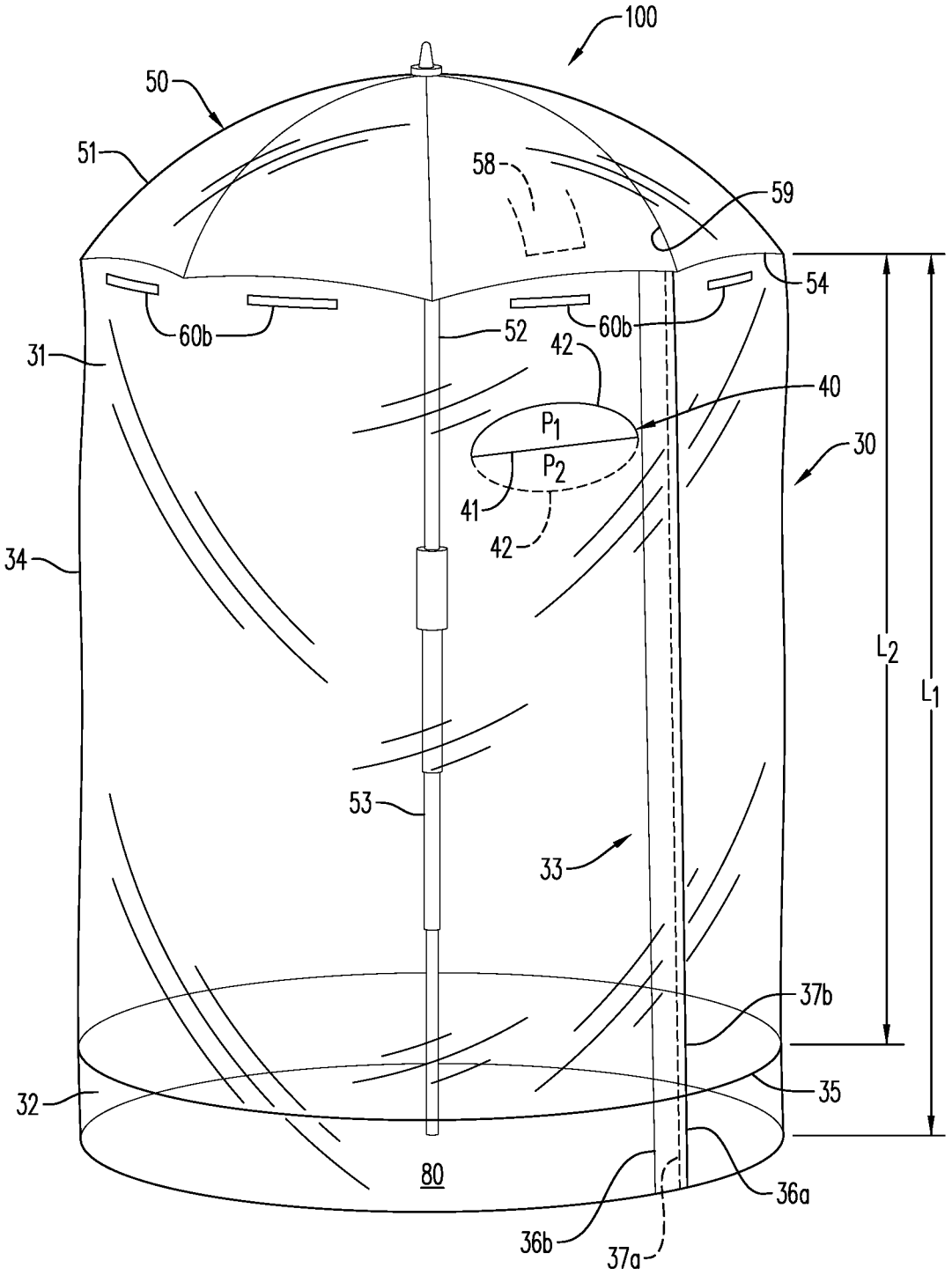
FIG. 9 is a side, perspective view of a protective device having a telescopic stem according to an embodiment.
Figure 10:
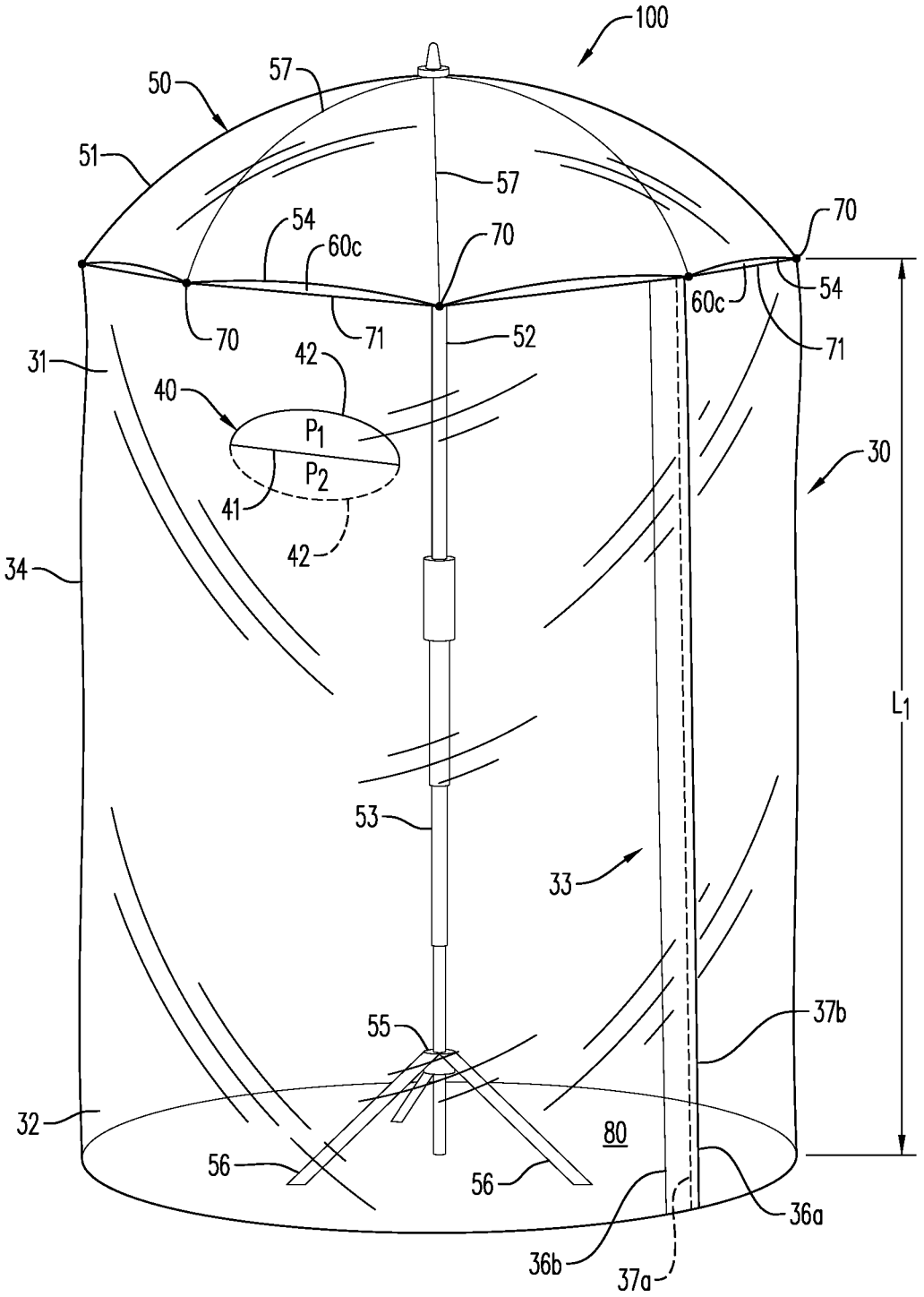
FIG. 10 is a side, perspective view of a protecting device having a telescopic stem and a support mechanism, according to an embodiment.

In each of the embodiments illustrated in FIGS. 2-10, the device 10 may include a protective member 30 configured to cover the user's lower body, thereby providing further protection against the weather elements. The protective member 30 may provide additional protection against unwanted materials, living and non-living, entering the protective member 30. The protective covering 30 may include a first end 31 and a second end 32. According to an aspect and as illustrated in FIGS. 2, 9 and 10, an access port 33 may extend substantially between the first end 31 and the second end 32. In an embodiment, the protective member 30 may include an air-permeable material. In an embodiment, the protective member 30 includes a mesh material that generally prevents unwanted dirt, debris, insects and the like, from entering the interior of the protective member 30 while still allowing air to circulate therethrough. According to an aspect, at least a portion of the protective member 30 is substantially see-through, or otherwise clear to aid user visibility, and is composed of an impervious waterproof material. The protective member 30 may include a plastic sheeting or film, including but not limited to nylon, polyester, polyethylene terephthalate (PET), polyethylene (high or low density), polycarbonate, polyvinyl chloride (PVC), vinyl, acrylic and the like, including portions that are transparent, semi-transparent and/or non-transparent materials. According to an aspect, at least a portion of the protective member 30 includes a light waterproof linen fabric, such as, for example, a linen shower curtain liner. The protective member 30 may include multiple colors, patterns and/or messages, such as company logos, school mascots, and the like, provided on the fabric from the chest or waist of the user to the second end 32. The umbrella 50 may, similar to the protective member 30, include multiple colors, patterns and/or messages provided on the canopy 51. In an embodiment, an upper portion of the protective member 30 may be substantially see through, so that it does not interfere with the user's visibility when walking. As illustrated in FIG. 3, the first end 31 may be substantially see through while the second end 32 is generally opaque, such that the user is provided with some level of privacy while the device 10 is in use. In some embodiments, the first end 31 and the second end 32 may include a substantially see through material. According to an aspect, the protective member 30 is composed of a waterproof fabric, a plastic material and/or combinations thereof. According to an aspect, the protective member 30 may be composed of a material that is substantially the same as the material of the protective covering 20. The protective member 30 may be formed contiguously with the protective covering 20.

In some embodiments, at least a portion of the protective member 30 includes a one-way visibility material configured for providing the user with a line of sight extending outwardly therethrough but not extending internally therethrough. The one-way visibility material may present one of an opaque surface or graphic image to persons positioned outside the protective member 30, thereby providing enhanced privacy for the user without compromising the user's line or sight through the protective member 30. According to an aspect, the protective material includes a tinted material that provides protection against UV rays and/or provides enhanced privacy for the user. According to an aspect, at least a portion of the protective member 30 includes an anti-fog coating configured to prevent condensation on the protective member 30. Such anti-fog coating may minimize the surface tension of the protective member 30 in a manner that does not allow beads of liquids, such as water, to form on the protective member 30. The anti-fog coating may be a surfactant film or a solution that is wiped on and subsequently wiped off the protective member 30. In an embodiment, at least a portion of the protective member 30 is anti-reflective. The protective member 30 may further include a reflective material and/or reflective portion and/or have a reflective coating thereon. This may help facilitate safe wearability at night, such that the user using the device 10 and/or protective device 100 would be easily spotted and/or identified in the dark.

Figure 4:
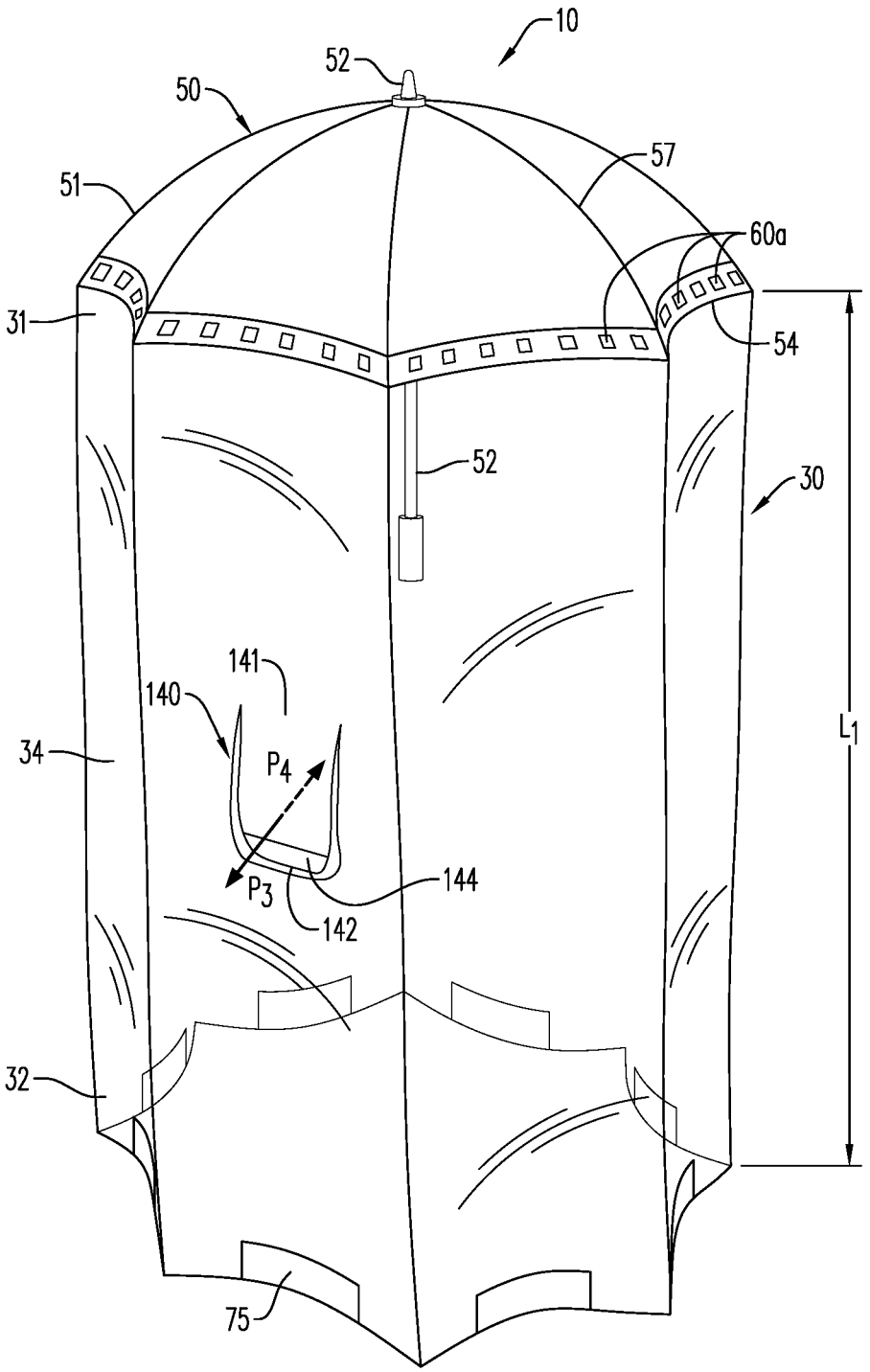
FIG. 4 is a side, perspective view of a protective device according to an embodiment, illustrating a hand-access mechanism and a weighted bottom portion.
Figure 5:
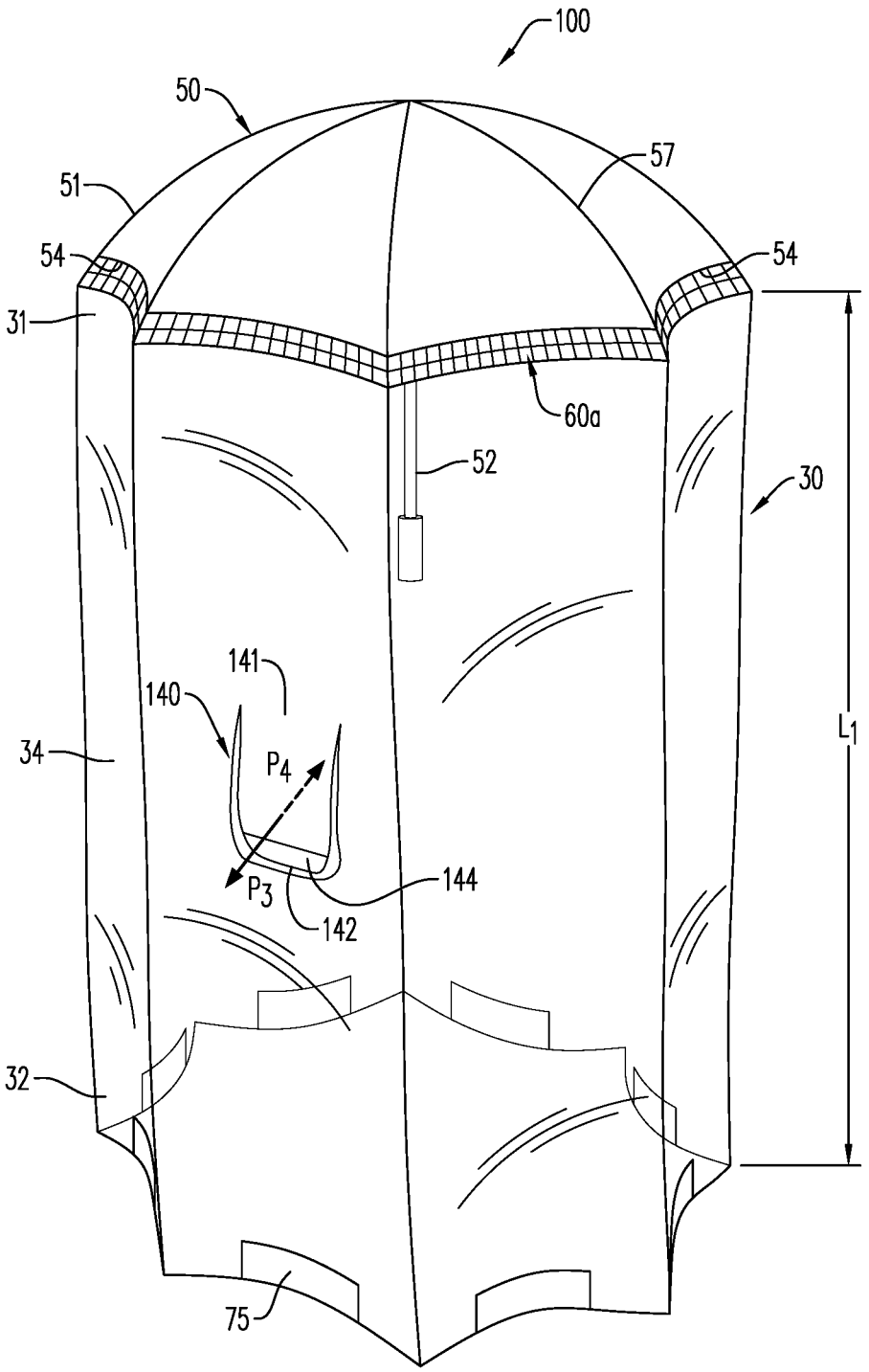
FIG. 5 is a side, perspective view of a protective device according to an embodiment, illustrating airflow conduits.
Figure 6:
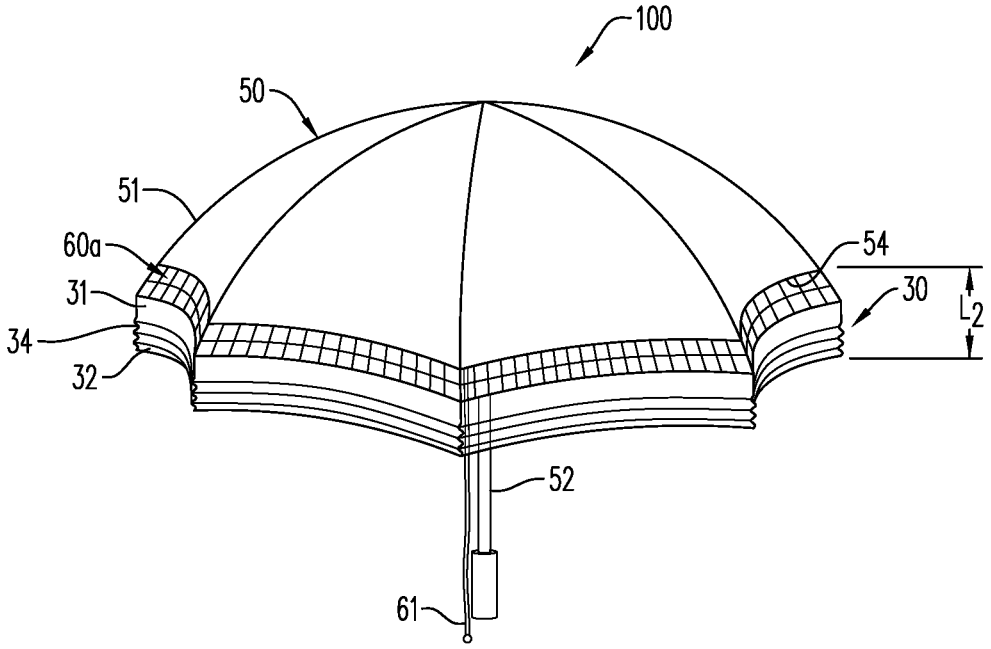
FIG. 6 is a side, perspective view of a protective device according to an embodiment, illustrating an adjustable length of a retractable protective member.

The protective member 30, as illustrated, includes a body 34. As illustrated in FIGS. 4-6, 9-10, the protective member 30 may include one or more airflow conduits 60*a*, 60*b*, 60*c*, which may be positioned in and/or adjacent to the body 34 of the protective member 30. Thus, the airflow conduits 60*a*, 60*b*, 60*c* provide a passageway for air to flow into and/or out of the enclosure formed by the protective member 30, thereby helping to provide ventilation for the user and to prevent the interior of the protective member 30 from becoming foggy. As shown in FIGS. 4-6, the airflow conduits 60*a* may be a strip of mesh-like material 60*a* that is positioned at or near the first end 31 of the protective member 30. In an embodiment, the airflow conduits 60*a* are provided by virtue of having a plurality of perforations and/or openings positioned substantially at the first end 31, such as, for example, the mesh-like material. In an alternative embodiment shown in FIG. 9, the airflow conduits 60*b* are formed by cutting a plurality of spaced-apart openings 60*b* in the body 34 of the protective member 30, near the first end 31. According to an aspect and as illustrated in FIG. 10, fasteners 70 may be positioned in a spaced apart relationship along an upper edge 71 of the first end 31 of the protective member 30 and used to fasten the first end 31 of the protective member 30 to the end of each spine 57 of the umbrella 50, or conversely, the fasteners 70 are attached to the ends of the spines 57 of the umbrella 50, for connecting the upper edge 71 of the first end 31 of the protective member 30. Thus, when the protective member 30 is attached using the spaced apart fasteners 70, a natural gap or airflow conduit 60*c* may be formed between the peripheral edge 54 of the umbrella and the first end 31 of the protective member 30. When positioned near the first end 31, the canopy 51 may serve a dual function of extending over and covering the airflow conduits 60*a*, 60*b*, 60*c* to keep the weather elements, such as, for example, rain water, from seeping into the protective member 30.

As illustrated in FIGS. 2, 3 and 7-9, the body 34 may include one or more scored portions 35 arranged substantially toward the second end 32. The one or more scored portions 35 may be adapted for adjusting the protective member 30 from a first length $L_1$ to an adjustable length $L_2$, thereby allowing the user to adjust the desired length as needed. The one or more scored portions 35 may include at least one of height markings, weakened portions, segmentations and perforations. Thus, the scored portions 35 may be configured to facilitate customization of the desired length of the protective member 30. For example, the user may choose a length that is based on the user's height so that, when in use, the protective member 30 is capable of providing full-body protection against the weather elements.

According to an aspect and as illustrated in FIG. 7, the protective member 30 may include one or more length adjusters 39, typically configured as a strap, band, tie, belt, tong, and the like. The length adjuster 39 may be adapted for adjusting the protective member 30 from the first length $L_1$ (see also, for instance, FIG. 3) to the second length $L_2$, without permanently modifying the protective member 30. According to an aspect, the length adjuster 39 is arranged near the second end 32 and substantially adjacent to the one or more scored portions 35 having, for example, the height markings. According to an aspect, multiple length adjusters 39 are positioned in a spaced-apart arrangement at intermittent locations around the periphery of the protective member 30. The second end 32 may be folded, gathered, collected, bunched, and/or rolled towards the first end 31 until the protective member 30 has been adjusted/shortened to the desired second length $L_2$. The length adjuster 39 may be respectively detachably attached to an inner surface 34' and an opposing outer surface 34" of the body 34 of the protective member 30, thereby forming a shortened second end 32' and at least temporarily maintaining the second length $L_2$. According to an aspect, the length adjusters 39 may be configured with a first adjuster end 39' and a second adjuster end 39", wherein either the first adjuster end 39' and/or the second adjuster end 39" are detachably or fixedly attachable to the inner surface 34' and/or outer surface 34" of the body 34. According to an aspect, the length adjuster 39 is adapted for adjusting the protective member 30 from the first length $L_1$ to a position under the canopy 51 of the umbrella 50, (not shown), such that the second end 32 is positioned substantially adjacent to or concurrent with the first end 31 of the protective member 30. Thus the first adjuster end 39' and the second adjuster end 39" may be attachable to an inner surface of the canopy 51, to position the protective member 30 substantially under the canopy 51 of the umbrella 50, thus protecting the protective member 30 from the weather elements, retracting, storing and securing the protective member 30 under the canopy 51 when not in use, and/or helping to maintain the shortened length $L_2$. It is contemplated that either one or both of the first adjuster end 39' and second adjuster end 39" are detachably attached to the inner surface 34' and the outer surface 34" of the body 34, respectively. In an embodiment, the second adjuster end 39" is a free end that is detachably engageable with an opposing fastener 70" positioned on the opposing outer surface 34" of the body 34. According to an aspect, the opposing fastener 70" is configured as a buckle (not shown) and the free or second adjuster end 39" of the length adjuster 39 is configured to be retained in the buckle. According to an aspect, one or both adjuster ends 39', 39" of the length adjuster 39 are completely detachable from at least one of the body 34 of the protective member 30 and the canopy 51. The first and second adjuster ends 39', 39" of the length adjusters 39 may each include fasteners 70' that are engageable with opposing fasteners 70" positioned on at least one of the interior and outer surfaces 34', 34" of the body 34, and the inner surface of the canopy 51. As described hereinabove and with reference to FIG. 10, fasteners 70', 70" may include one or more buckles, snaps/clips, stitches (in the case of a fixed attachment arrangement), rivets, Velcro® and the like. In the embodiment in which the fastener 70 is not detachable, such as a rivet, no opposing fastener is required. In an embodiment, the length adjusters 39 may wrap around the shortened second end 32', such that the fasteners 70' on at least one of the first adjuster end 39' and the second adjuster end 39" at least temporarily engage with and/or affix to the opposing fasteners 70" on the inner and outer surfaces 34', 34" of the body 34, thereby maintaining the second length $L_2$. In other words, the fasteners 70' and opposing fasteners 70" may be detachably engaged and/or detachably affixed to each other, such that the protective member 30 may be customized for use by multiple users and/or be customized to various user heights.

According to an aspect, the protective member 30 includes a continuous sheet having a first sheet edge **36*a* and a second sheet edge 36*b*, the first and second sheet edges 36*a*, 36*b* extend between the first end 31 and the second end 32 and form the access port 33 for the user's entry into and exit from the protective member 30. In an embodiment, the first sheet edge 36*a* is provided with a closure member 37*a* and the second sheet edge 36*b* is provided with an opposing closure member 37*b*. While FIGS. 2, 4-6 and 9-10 illustrate the closure members 37*a*, 37*b* extending along the first sheet edge 36*a* and the second sheet edge 36*b*, it is to be understood that the closure members 37*a*, 37*b* may be positioned at any position along the sheet edges 36*a*, 36*b*. According to an aspect, the closure members 37*a*, 37*b* are centrally located along the first and second sheet edges 36*a*, 36*b*. The first closure member 37*a* and the opposing closure member 37*b* may be alignable and engageable to close the access port 33 and releasable to open the access port 33. Such closure members 37*a*, 37*b* include, but are not limited to magnets, clips, snaps, Velcro® and the like. According to an aspect, the closure members 37*a*, 37*b* include a single-handed closure mechanism that allows the access port 33 to easily open and/or close. For example, the closure member 37*a* may be a hook mechanism and the opposing closure member 37*b* may be a loop mechanism. Such hook-loop fastening mechanisms may be strong, easy to use and substantially maintenance-free. To be sure, closure members 37*a*, 37*b* may be any closure mechanism that easily opens and/or closes, engages and/or disengages without unduly compromising the protective member 30. As contemplated herein, a zipper would not be a suitable closure member 37*a*, 37*b*, at least because it may easily jam, particularly if it extends along an entire length of the access port 33. According to an embodiment, the first sheet edge 36*a* and/or the second sheet edge 36*b* are provided with markers (not shown), such as, but not limited to a nylon or polyester binding configured to facilitate the user's ease in easily identifying the access port 33. The markers may include a material that is easily identifiable by, for example, color, texture and/or any other means that distinguishes it from the protective member 30 and highlights the access port 33**.

According to an aspect, the protective member 30 is strong and/or sturdy and is capable of withstanding the weather elements by virtue of the material used to make the protective member 30 and/or the second end 32 of the protective member 30. In an embodiment and as illustrated in FIG. 4, one or more anchoring members 75 may be provided on the protective member 30. According to an aspect, anchoring members 75 are arranged on the body 34 of the protective member 30. In an embodiment, anchoring members 75 are removably coupled to the second end 32. The anchoring member 75 may be configured as pockets configured to receive a plurality of weights therein, thereby forming a weighted and/or stabilized second end 32 that helps to facilitate the protective member 30 hanging downwardly from the umbrella 50 in any weather condition, such as, for example, during occurrence of windy weather conditions, during which wind may blow from the side and the user may get wet and/or dirty. According to an aspect, the anchoring members 75 may help maximize the performance of the protective device 100, by providing protection in any weather condition. In an embodiment, a reinforcement material (not shown) may be positioned along the second end 32 at the hemline of the protective member 30 and between each adjacent anchoring member 75 to help to prevent the protective member 30 from being blown around and prevent the user from tripping. According to an aspect, the anchoring member 75 includes magnets that are removably attached to the second end 32. As illustrated in FIG. 4, the anchoring member 75 may be arranged at intermittent positions around a periphery of the second end 32 of the protective member 30. According to an aspect, the anchoring member 75 includes at least one of a hemmed edge having weights, beads and/or magnets removably positioned or secured therein. In an embodiment, the second end 32 includes perforations configured to receive one or more anchoring members 75.

The protective member 30 may include a window 40 having a first edge 41 and a second edge 42. According to an aspect, the first edge 41 is affixed to the protective member 30. The first edge 41 may be affixed to or may extend from the protective member 30. In an embodiment and as illustrated in FIGS. 9-10, the second edge 42 is configured to be vertically moveable and/or sealable from a closed position $P_1$ to an open position $P_2$. According to an aspect, the second edge 42 may include a sealing and/or closing mechanism (not shown) that is substantially the same as the closure members **37*a*, 37*b* of the protective member 30. In an embodiment, the sealing and/or closing mechanism of the second edge 42 may be dissimilar from the closure members 37*a*, 37*b*. Thus, it is possible to provide an embodiment in which the sealing and/or closing mechanism of the second edge 42 is made of a material other than the material used to make the closure members 37*a*, 37*b*. For example, in embodiments where the closure members 37*a*, 37*b* are snaps, the sealing and/or closing mechanism of the second edge may be magnets, clips, Velcro®, zippers or the like. The position "$P_1$" is intended to show the closed position wherein second edge 42 closes the gap and/or window 40 formed when the second edge 42 is moved to position "$P_2$", in the open position. It would be understood by one of ordinary skill in the art that the second edge 42 could be fixed and the first edge 41 could be moveable to a closed/open position (not shown.) The window 40 may be arranged at any position on the body 34 of the protective member 30. According to an aspect and as illustrated in FIGS. 9-10, the window 40 is positioned away from the second end 32 and substantially toward the first end 31 of the protective member 30, such that when the device 10 is in use, the window 40 may be substantially located at or near the user's eye level. In an embodiment, the window 40 provides a substantially waterproof seal when positioned in the closed position $P_1$. Thus, the window 40** may be adapted for at least one of observation and admittance of light and air therethrough.

According to an aspect and as illustrated in FIGS. 4-5, the protective member 30 may include a hand-access port 140, such as an inserted slip, window, slit, window shield or flap 142, positioned somewhat centrally in the body 34. According to an aspect, the hand-access port 140 is affixed to or extends downwardly from the protective member 30 and flap 142 is configured to be moveable along a direction defined by $P_3$ to $P_4$. The hand-access port 140 may be adapted for communication with at least one of an interior position of the protective member 30 and an exterior position of the protective member 30, such as to facilitate the opening of a car door or for retrieving packages from the outside of the protective member 30. To be sure, the hand-access port 140 may be arranged at any desired position in the body 34. In an embodiment and as illustrated in FIGS. 4-5, the hand-access port 140 is centrally arranged on the body 34 of the protective member 30, between the first end 31 and the second end 32 and at a height convenient for passing a hand of the user therethrough, such that the hand-access port 140 functions as an entryway and/or portal that facilitates the user's ease of access to and/or to retrieval of items external to the protective member 30. According to an aspect, the hand-access port 140 is positioned in the body 34 such that it is adjacent the user's elbow to allow freedom to open a car door or retrieve packages. According to an aspect and illustrated in FIG. 4, the flap 142 may include a closure mechanism 144 configured to close, open and/or seal the hand-access port 140. According to an aspect, the closure mechanism 144 includes a magnetic strip on the lower surface of the flap that will interact with a magnetic strip on the body 34 and help to secure the flap 142 when not in use. The closure mechanism 144 may be substantially the same as the closure members 37*a*, 37*b* of the protective member 30.

Now referring particularly to FIGS. 5-10, a protective device 100 is illustrated. The protective device 100 may include an umbrella 50 and a protective member 30 extending therefrom, to provide a user with full body protection against weather elements. In an embodiment, the umbrella 50 includes a canopy 51 and a shaft 52 extending from a center of the canopy 51.

In an embodiment and as illustrated in FIG. 8, the canopy 51 includes an upper canopy portion 51A and a lower canopy portion 51B. The lower canopy portion 51B may be configured to extend at least to a shoulder of the user when the protective device 100 is in a substantially upright and open position. According to an aspect, the canopy includes a substantially see through material. In some embodiments, some portions of the canopy 51 may be substantially see through while others are not substantially see through. The canopy 51 may include a canopy window 45 having a first border 46 and a second border 47. The second border 47 being configured to be moveable from a closed border position $P_5$ to an open border position $P_6$, and the canopy window 45 being adapted for at least one of observation and admittance of light and air therethrough. According to an aspect, the canopy window 45 may include a mesh-like material, such as, for example, the airflow conduits 60*a*, 60*b*, 60*c* described hereinabove and illustrated in FIGS. 4-6 that helps facilitate the admittance of light and air therethrough.

The canopy 51 of the umbrella 50 may be supported by a plurality of spines 57 extending from the center of the canopy 51 and configured for supporting the canopy 51. According to an aspect, the spines 57 are fixed to the canopy 51 and facilitate opening and closing of the canopy 51. The spines 57 may be configured to facilitate collapsing and/or folding the umbrella 50 into a closed position. In an embodiment, the canopy 51 of the umbrella 50 includes a storage member 58 coupled to a lower surface 59 of the umbrella 50. The storage member 58 may be secured to the lower surface 59 of the umbrella by any securing means configured to hold the storage member 58 in place and withstand the weight of items placed in the storage member 58, such as being sewn to the underside of the canopy 51. As shown herein, the storage member 58 is attached along three of its sides to the canopy 51, thereby creating a pocket with an open end.

In an embodiment, the protective member 30 extends from and/or is attached to a peripheral edge 54 of the canopy 51, such that precipitation, for example, rain/water, falling off or over the edge of the canopy 51 will fall outside the protective member 30. According to an aspect, the protective member 30 extends from and/or is attached at a position underneath the canopy 51. As illustrated in FIG. 10, the protective member 30 may include fasteners 70 configured to couple the protective member 30 to at least one of the canopy 51 and/or the spines 57 of the umbrella 50 to the protective member 30. In an embodiment, the fasteners 70 are configured for detachable fastening to the spines 57 of the umbrella 50 such that at least one airflow conduit 60*c* is formed between a naturally occurring gap that forms between the peripheral edge 54 of the umbrella 50 and an upper edge of the first end 31 of the protective member 30 by virtue of attaching the protective member 30 to the canopy 51. According to an aspect, the fasteners 70 include one or more snaps/clips, stitches, rivets, Velcro® and the like. The attachment of the protective member 30 to the umbrella 50 in this way may provide a substantially constant airflow between an enclosed area 38*a* of the protective member 30 and an external area 38*b* of the protective member 30.

According to an aspect and as illustrated in FIG. 6, the protective device 100 may include an extension/retraction member 61. The extension/retraction member 61 may include a rope or drawstring with some sort of pulley mechanism (not shown) configured to enable the user to extend and/or retract the protective member 30 to a desired length. According to an aspect, the extension/retraction member 61 includes a drawstring that is vertically threaded through a plurality of positions on the body 34 of the protective member 30 (also not shown) and that facilitates the extendibility and retractability of the protective member 30. The extension/retraction member 61 may otherwise be coupled to the body 34 of the protective member 30, such that the protective member 30 can be lowered from a shorter length $L_2$ to a longer length $L_1$, (see, for instance, FIG. 5), to protect clothing and packages being carried from getting wet when the wind blows the rain or snow from the side. Lowering of the protective member 30, may provide the user and/or items being transported by the user with protection against the weather elements, and protection of the user's valuables from thieves and/or pickpockets. Similarly, the protective member 30 is retractable from the longer length $L_1$ to the shorter length $L_2$. In other words, the extension/retraction member 61 may provide a mechanism to vary the length of the protective member 30, to protect the user. Once lowered or retracted, the protective member 30 may be locked into the position. According to an aspect, the protective device 100 may include a hands free version that does not require the user to physically/manually hold the umbrella 50 upright in order to be protected by the protective covering 30, thereby allowing the user free use of both of the user's hands. Hands free versions can be designed to provide protection for users driving golf carts, those confined to wheelchairs and those driving open vehicles, such as those used in theme parks and stadium parking lots.

According to an aspect and as shown in FIGS. 9-12, the shaft 52 of the umbrella 50 may include a telescopic stem 53. As illustrated in FIGS. 9-10, the telescopic stem 53 may be configured for extension to a support structure 80. According to an aspect, the telescopic stem 53 is configured to support the protective device 100 when extended into its supporting position. As illustrated in FIG. 9, the telescopic stem 53 may be further connectable to a support mechanism 55, which is adapted to support the protective device 100, such that the user does not have to hold the shaft 52 and/or the telescopic stem 53 to maintain the protective device 100 in a substantially upright and open position. The support mechanism 55 may include any device that is configured to provide stability to horizontal and downward forces, such as, for example, weather elements including the wind. As shown in FIG. 10, the support mechanism 55 may be extended to and balanced on top of the ground 80. The support mechanism 55 may includes multiple legs 56 and is adapted to be removably connected to the telescopic stem 53. In an embodiment, the support mechanism 55 is configured as a tripod stand, having three legs 56 extending therefrom. According to an aspect, the legs 56 may be pivotably connected to the support mechanism 55. The legs 56 may be equiangularly spaced around the support mechanism 55. To be sure, the legs 56 may be positioned at any angular position—relative to the support mechanism 55 and each other—that is capable of providing additional support to the protective device 100.

Figure 11A:
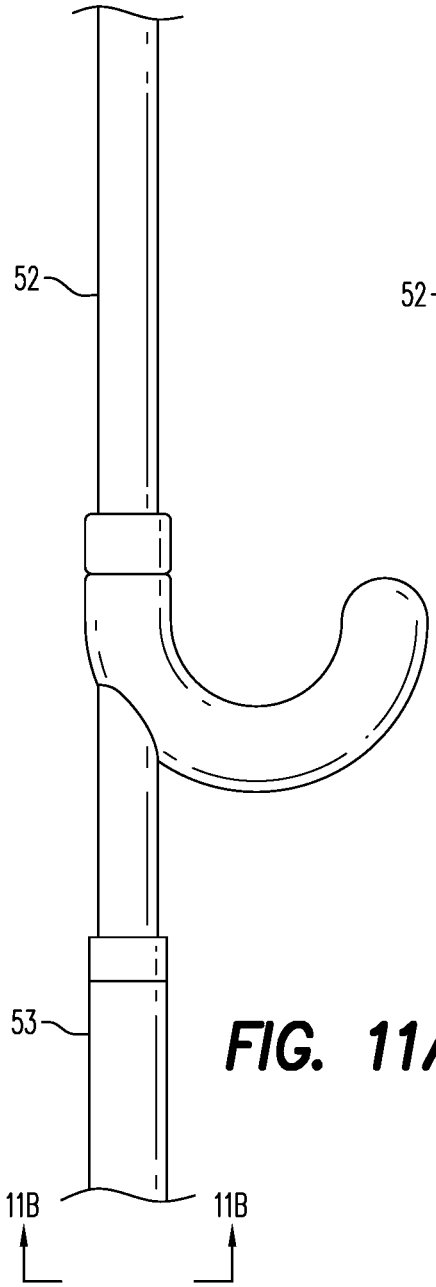
FIG. 11A is a side view of a handle of an umbrella having a telescopic stem, according to an embodiment.
Figure 11B:
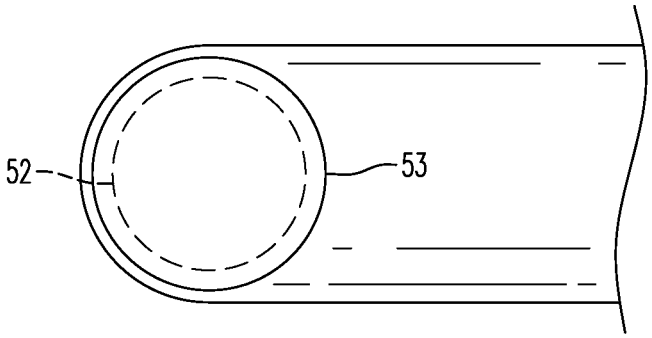
FIG. 11B is bottom view (cross-sectional bottom view) of the handle and telescopic stem taken along lines 1-1 of FIG. 11A.

Now turning to FIGS. 11A-11B, the telescopic stem 53 is illustrated according to an embodiment in which the telescopic stem 53 extends from a non-linear handle. As illustrated, the telescopic stem 53 may have a first tubular element that is slidably positioned in a second tubular element, such that the telescopic stem 53 is extendable from a first length to a second length. In other words, the telescopic stem 53 may have one or more stem sections that operate to extend the length of the telescopic stem 53.

Figure 12:
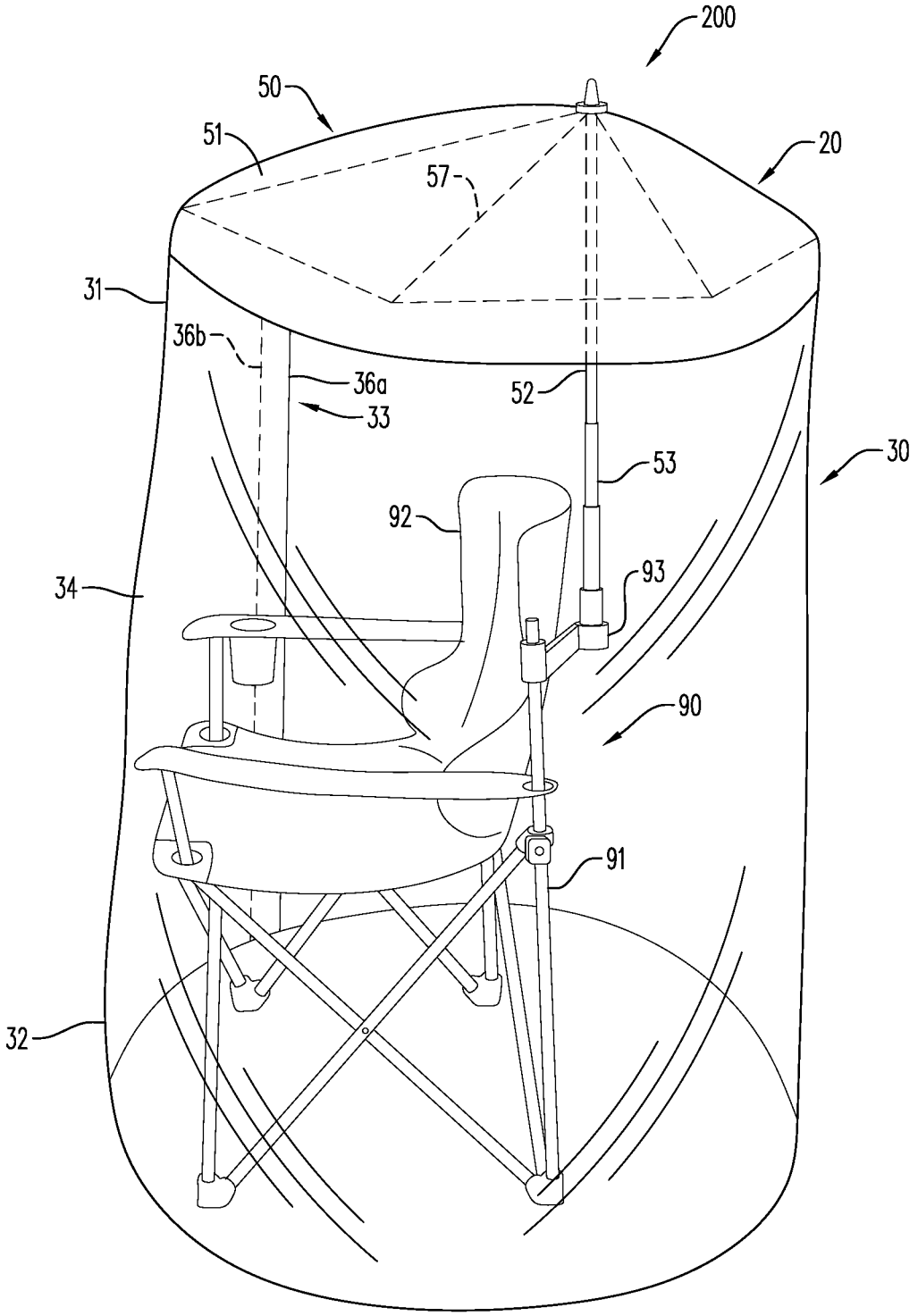
FIG. 12 is a side, perspective view of a portable protective device according to an embodiment.

Now referring to FIG. 12, according to an embodiment a portable protective device 200 configured for providing a seated user with full body protection against weather elements is provided. The portable protective device 200 may include an umbrella 50 and a protective member 30 affixed to and/or extending therefrom. According to an aspect, the umbrella 50 includes a canopy 51 and a shaft 52 extending substantially from a center of the canopy 51. As shown in FIG. 12, the shaft 52 extends substantially from the center of the canopy 51, but is offset to facilitate adequate coverage of a chair 90. The protective member 30 may extend from a peripheral edge 54 of the canopy 51. The protective member 30 may include a first end 31, a second end 32 and an access port 33 extending substantially between the first end 31 and the second end 32. According to an aspect, at least a portion of the protective member 30 is substantially see-through and is composed of an impervious waterproof material as described hereinabove. To be sure, any of the features described hereinabove to other embodiments, including but not limited to venting, visibility, adjustability, and the like, can be incorporated into the portable protective device 200.

As illustrated in FIG. 12, the portable protective device 200 further includes a collapsible chair 90. According to an aspect, the shaft 52 may be coupled to a chair attachment member 93 and may be configured to support the portable protective device 200 when configured in its extended position. In an embodiment, the chair 90 includes a frame 91 and a supporting member 92, shown as a supporting fabric for accommodating the seated user. The frame 91 may be configured to receive the supporting fabric 92 and the chair attachment member 93 thereon. In an embodiment, the shaft 52 is configured for extension to the frame 91 of the collapsible chair 90 and is capable of supporting the portable protective device 200 when the umbrella 50 is configured in its extended position.

According to an aspect, a carrying member (not shown) is provided for ease of transport of the protective covering 10, the protective device 100, the portable protective device 200 and/or any components thereof. The carrying member may be configured for receiving and/or storing at least one of the umbrella 50, the protective member 30 and/or the collapsible chair 90. In an embodiment, the carrying member is configured for receiving and/or storing the umbrella 50, the protective member 30 and the collapsible chair 90, such that the user does not have to carry each separately. The carrying member may include cloth, canvas, plastic and/or any other sturdy material. According to an aspect, the carrying member includes a waterproof and foldable material.

FIGS. 13A-18 each illustrate alternate embodiments of a protective device 300 configured for providing a user with body protection. The protective device 300 includes an umbrella 50 and a protective member 30. The umbrella 50 and protective member 30 may be configured substantially as described hereinabove and illustrated in FIGS. 2 to 12, thus for purposes of convenience and not limitation, similar aspects, features and functionality are not repeated in detail hereinbelow.

Figure 13A:
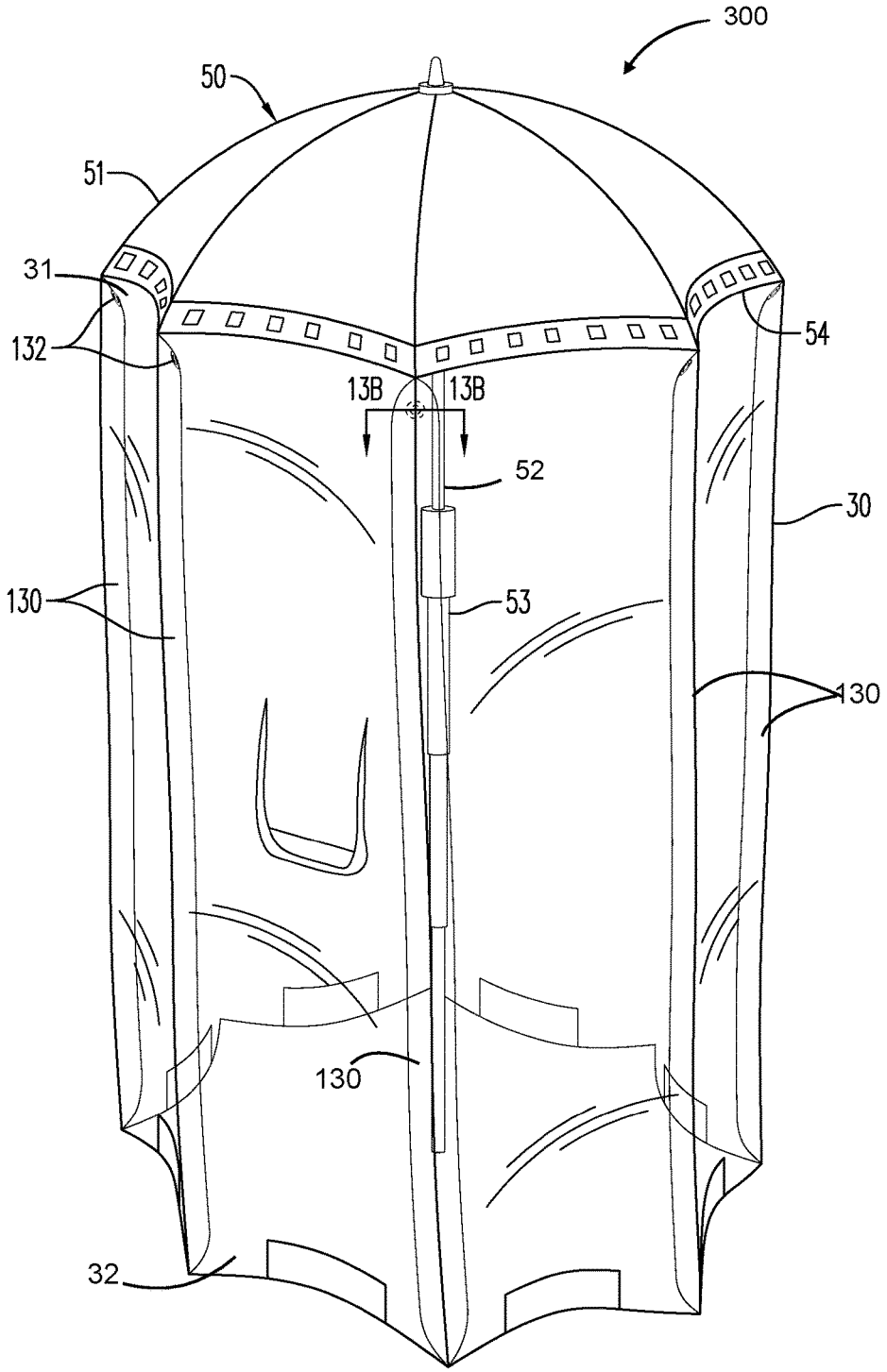
FIG. 13A is a perspective view of a protective device including an inflatable and sealable pocket, according to an embodiment.

FIG. 13A illustrates the protective device 300 including the umbrella 50, the protective member 30 extending from a portion of the umbrella 50, and an inflatable and sealable pocket 130 extending along a portion of the protective member 30. The umbrella 50 has a canopy 51 and a centrally positioned shaft 52 extending from a center of the canopy 51. According to an aspect, the shaft 52 includes a telescopic stem 53 that provides support to the protective device 300 when configured in its extended position. The telescopic stem 53 includes tubular elements that are slidably positioned in other tubular elements, such that the telescopic stem is collapsible and extendable between multiple lengths.

The protective member 30 has a first end 31, and a second end 32 opposite the first end 31. The first end 31 of the protective member 30 extends from or is otherwise connected to the canopy 51. According to an aspect, the first end 31 is connected to the peripheral edge 54 of the canopy 51 of the umbrella 50. The inflatable and sealable pocket 130 is formed in the protective member 30 and extends between the first end 31 and second end 32. According to an aspect, the inflatable and sealable pocket 130 may be formed on an inner surface of the protective member. The pocket 130 is configured for providing rigidity to the protective member 30. The inflatable and sealable pocket 130 is integrated within the structure of the protective member 30, such that a user can easily inflate and deflate the pocket 130 when desired. According to an aspect, the inflatable and sealable pocket 130 is positioned along the length of the protective member 30. It is contemplated, however, that the inflatable and sealable pocket 130 may be positioned around the periphery of the protective member 30. In an embodiment, the pocket 130 may be positioned along less than the entire length or less than the entire periphery of the protective member 30.

Figure 13B:
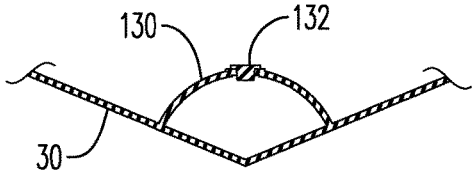
FIG. 13B is a top view of the inflatable and sealable pocket of the protective device of FIG. 13A, in an inflated state, according to an embodiment.

As seen, for example, in FIG. 13B, the inflatable and sealable pocket 130 may include a sealing mechanism/plug 132 that can be opened to add air into the pocket 130 and closed to seal the air in the pocket 130. To deflate the inflatable and sealable pocket 130, the user can open the plug and simply compress on the pocket 130 to release the trapped air. The plug 132 may be provided on an interior surface of the protective member 30, such that a user can access the plug 132 to inflate or deflate the pocket 130 while using the protective device 300.

Figure 13C:
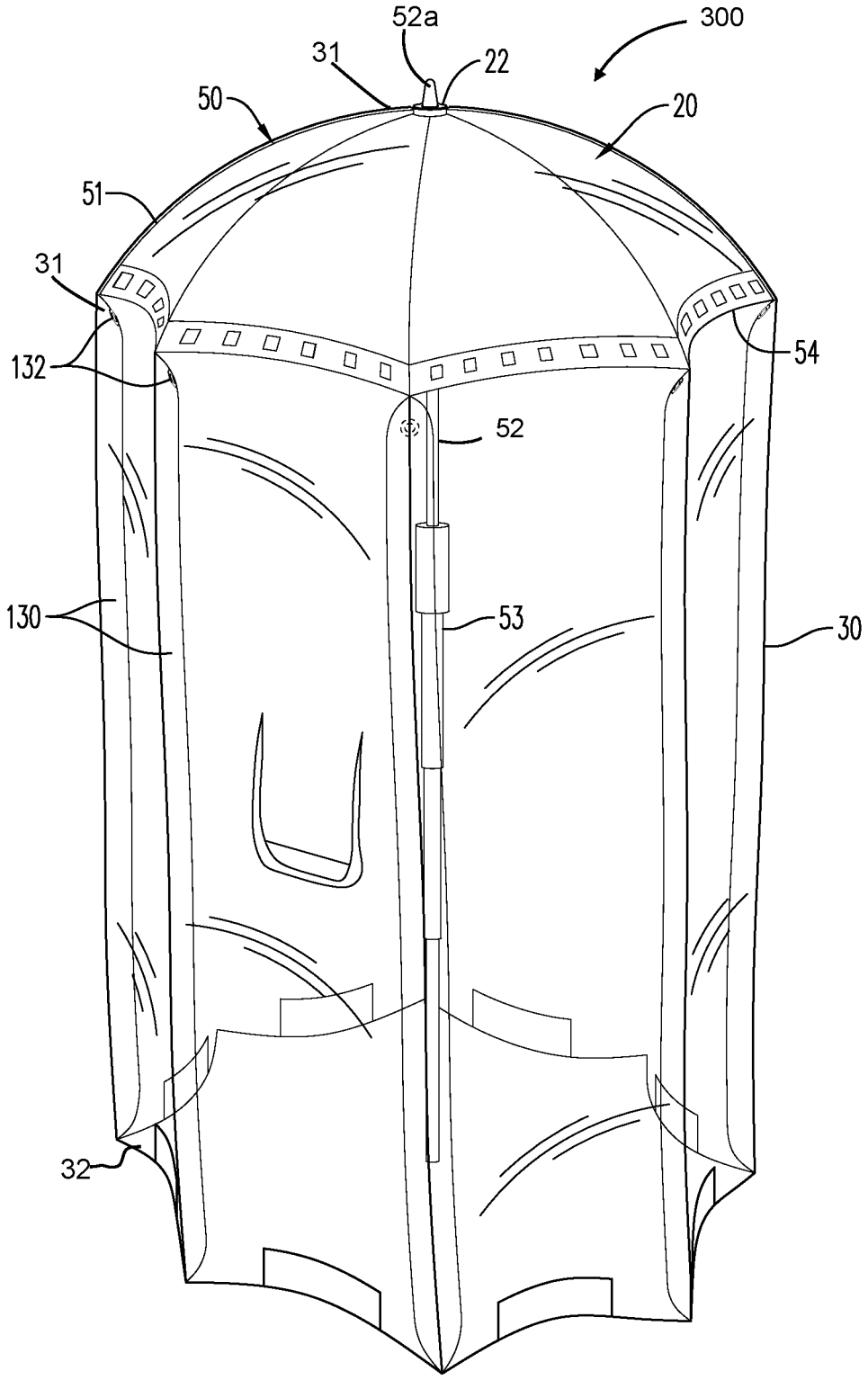
FIG. 13C is a perspective view of a protective device, illustrating a protective member including an inflatable and sealable pocket positioned over a canopy, according to an embodiment.

FIG. 13C illustrates an alternate embodiment, wherein the protective member 30 is positioned over the canopy 51 of the umbrella 50. In this configuration, the first end 31 of the protective member 30 is adjacent a first end 52*a* of the umbrella shaft 52. The inflatable and sealable pocket 130 is only formed in a portion of the length of the protective member 30, such as at a position below the peripheral edge 54 of the canopy 51 to the second end 33 of the protective member 30. This may ensure that the protective member 30 is rigid only in the areas that would surround a user's body, while the upper portion of the protective member, that is the portion closest to the first end 31, remains sufficient flexible to fit over and match the contours of the canopy 51 of the umbrella 50.

Figure 14A:
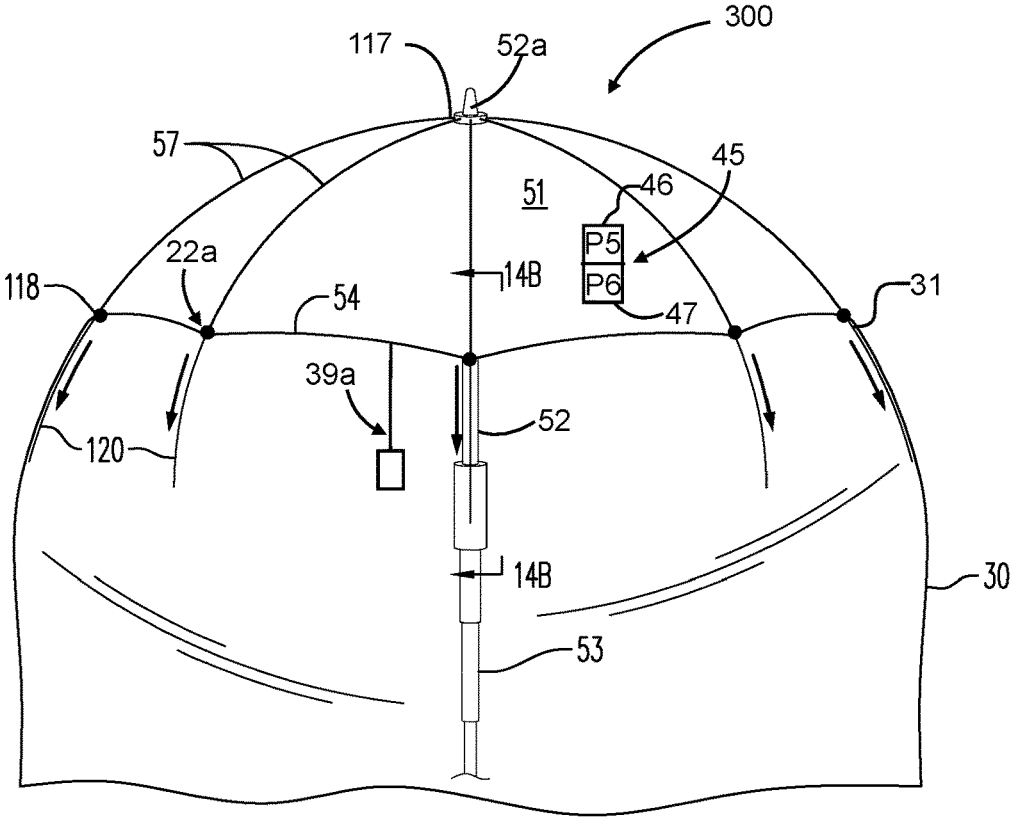
FIG. 14A is a perspective view of a protective device including a telescoping rigid segment, according to an embodiment.
Figure 14B:
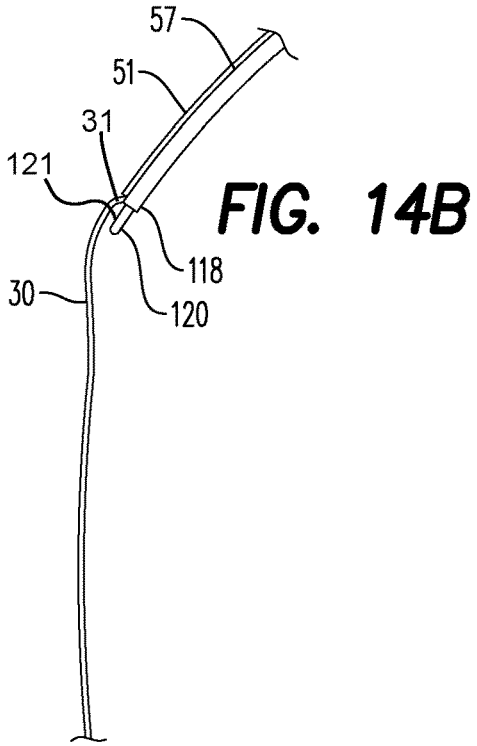
FIG. 14B is a perspective view of the telescoping rigid segment of FIG. 14A in a retracted position, according to an embodiment.
Figure 14C:
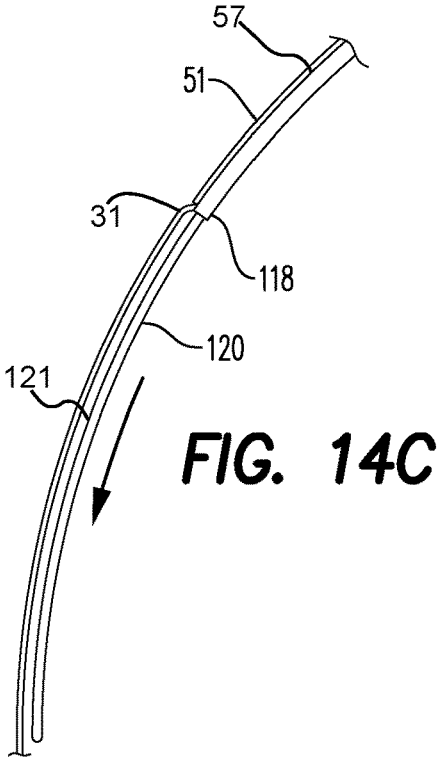
FIG. 14C is a perspective view of the telescoping rigid segment of FIG. 14A in an extended position, according to an embodiment.

FIGS. 14A-14C and FIGS. 15A-15C illustrate alternate embodiments of the protective device 300. The protective device 300 includes an umbrella 50 having a canopy 51, and a protective member 30 positioned over the canopy 51 (FIGS. 15A-15C) or extending from or otherwise secured to the peripheral edge 54 of the canopy 51 (FIGS. 14A-14C). The umbrella 50 and protective member 30 may be configured substantially as described hereinabove and illustrated in FIGS. 2 to 12, thus for purposes of convenience and not limitation, similar aspects, features and functionality are not repeated in detail hereinbelow.

Figure 15A:
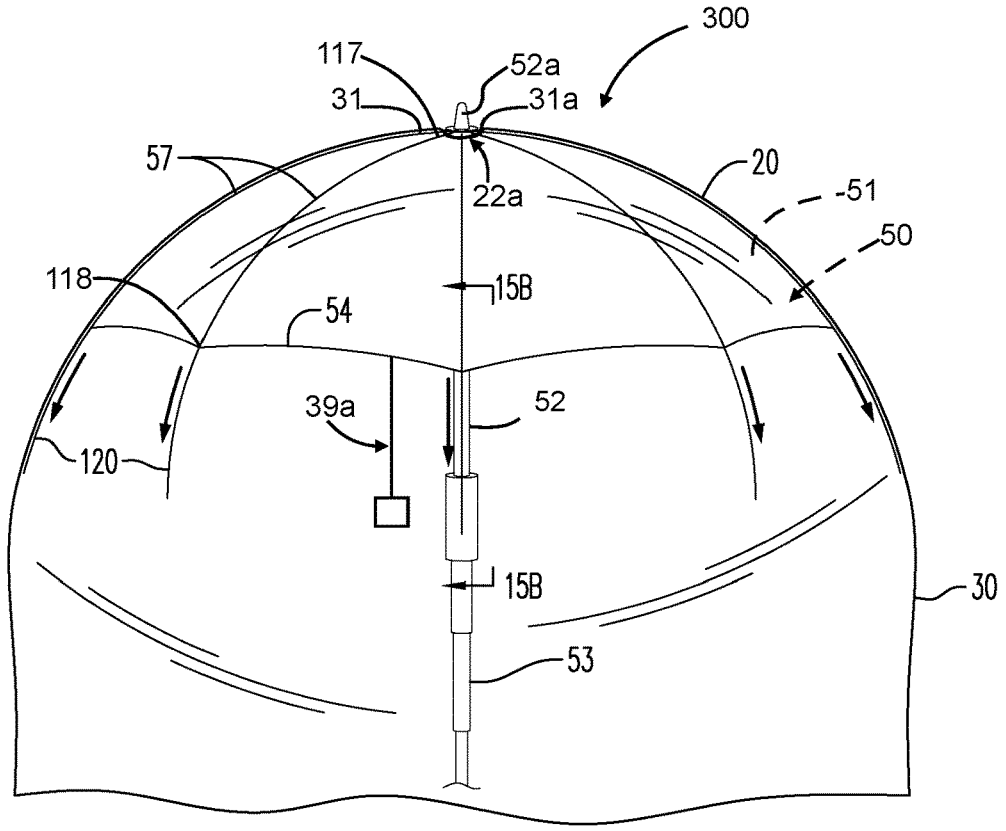
FIG. 15A is a perspective view of a protective device including a telescoping rigid segment, according to an embodiment.
Figure 15B:
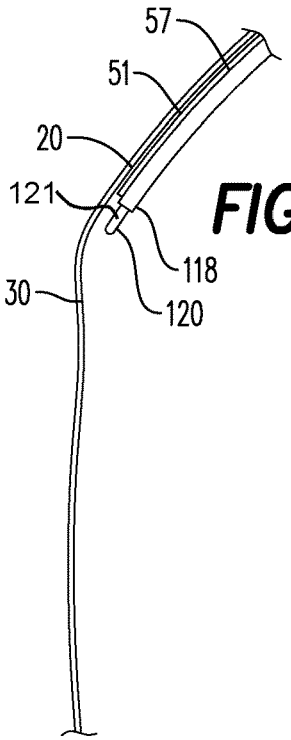
FIG. 15B is a perspective view of the telescoping rigid segment of FIG. 15A in a retracted position, according to an embodiment.
Figure 15C:
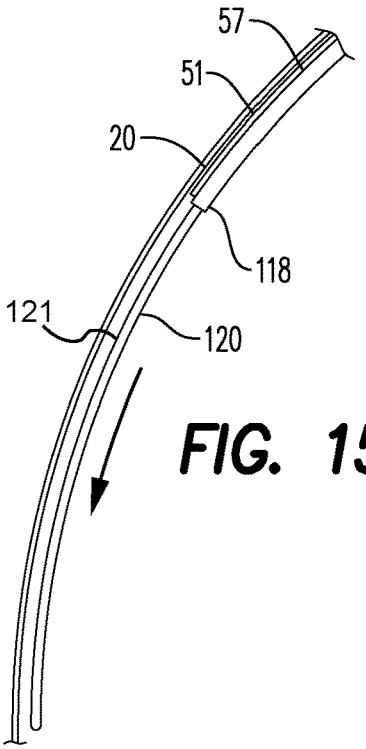
FIG. 15C is a perspective view of the telescoping rigid segment of FIG. 15A in an extended position, according to an embodiment

FIGS. 14A and 15A illustrate a centrally positioned shaft 52 extending from a center of the canopy 51. The centrally positioned shaft 52 includes a telescopic stem 53 configured to support the protective device 300 when configured in its extended position. The telescopic stem 53 may be configured substantially as described hereinabove and illustrated in FIGS. 9-10, FIGS. 11A-11B and FIG. 13A, thus for purposes of convenience and not limitation, the various features, aspects and functionality of the telescopic stem 53 are not repeated in detail hereinbelow.

A plurality of umbrella spines 57 extend from the centrally positioned shaft 52 in a radial direction from the center of the canopy 51. According to an aspect, each umbrella spine 57 has a proximate end 117 originating adjacent the centrally positioned shaft 52, and a distal end 118 spaced apart from and opposite the proximate end 117. The distal end 118 houses a telescoping rigid segment 120 that is configured for radial extension from the distal end 118. The telescoping rigid segment 120 includes a tubular segment 121 slidably received within a spine 57 of the plurality of umbrella spines 57. According to an aspect, the telescoping rigid segment 120 further includes a plurality of tubular segments 121, each segment of the plurality of tubular segments 121 being slidably received within a spine of the plurality of umbrella spines 57. In this configuration, the plurality of tubular segment 121 is configured to move radially and vertically as a single unit. An adjustment mechanism/length adjuster 39*a* may be provided to facilitate this movement. According to an aspect, the adjustment mechanism 39*a* is configured to raise, lower or fix the plurality of telescoping rigid segments in position. A locking mechanism and a release mechanism may be provided to lock the tubular segments 121 in place or release them so that they extend along the length of the protective member 30 or are collapsed into and retained in the umbrella spines 57.

The centrally positioned shaft 52 may include a first end 52*a* that is spaced apart from the telescoping stem 53. As illustrated in FIG. 15A, the protective member may be secured to the first end 52*a* of the centrally positioned shaft 52. According to an aspect, the first end 52*a* of the shaft 52 extends through an opening 31*a* formed in the protective member 30. Alternatively, and as illustrated in FIG. 14A, the first end 31 of the protective member 30 may be secured to the peripheral edge 54 of the canopy 51 of the umbrella 50. Attachment members 22*a* may be provided to secure the protective member 30 to the umbrella 50. As illustrated in FIG. 14A, the attachment member 22*a* may couple the protective member 30 to the distal end 118 of the spine 57 of the umbrella (FIG. 14A) or may couple the protective member 30 to the first end 52*a* of the centrally positioned shaft 52 (FIG. 15A). It is contemplated that one or more of the attachment member 22*a* may include an elastic portion configured to cinch and elastically engage the first end 52*a* of the shaft 52 (FIG. 15A) or the distal end 118 of the spine 57 (FIG. 14A).

As illustrated in FIGS. 14B-14C and FIGS. 15B-15C, the protective member 30 extends over the telescoping rigid segment 120, such that when the rigid segment 120 is in an open or extended configuration, the rigid segment 120 supports the protective member 30 in the radially extended position. In other words, the protective member 30 is in contact with the rigid segment 120 when the rigid segment 120 is in the extended position such that the protective member 30 is urged radially away from the centrally positioned shaft 52. According to an aspect, a radial cross-section of the protective member 30 below the peripheral edge 54 has a greater diameter than the diameter of the peripheral edge. The protective member 30 includes a first end/an upper end 31 and a second end/lower end 32. The plurality of telescoping rigid segments may be configured to extend to a position between the upper end 31 and the lower end 32 of the protective member 30. The protective member 30 may be composed of an impervious waterproof material, with at least a lower portion of the protective member being substantially transparent, such that when the protective member 30 is in its extended position, a user can easily see through the protective member 30.

Figure 16A:
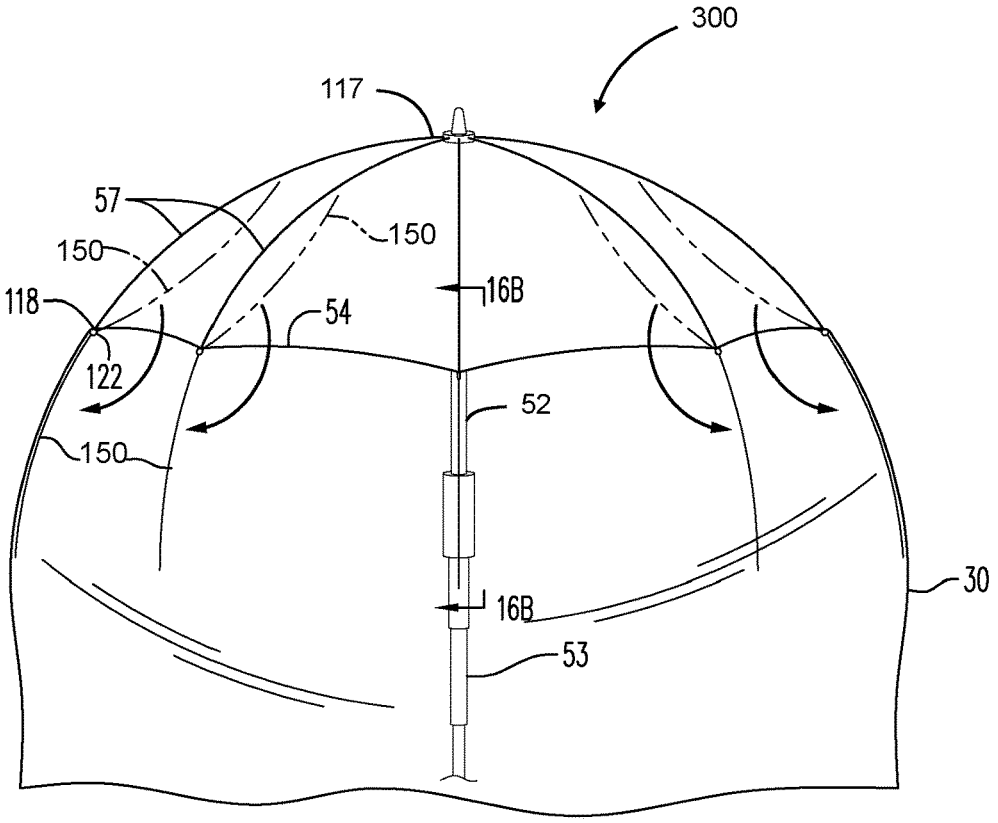
FIG. 16A is a perspective view of a protective device including a folding rigid arm, according to an embodiment.
Figure 16B:
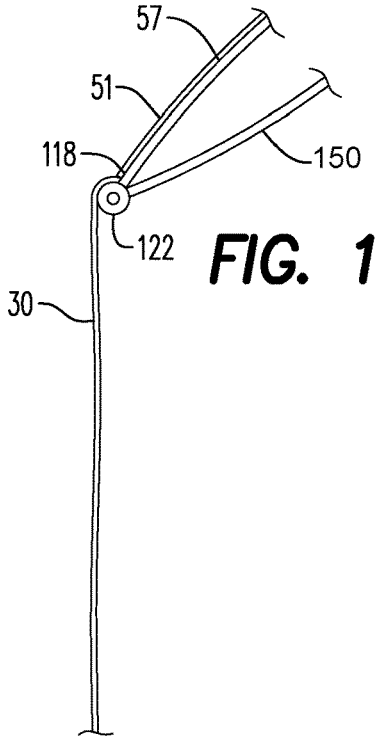
FIG. 16B is a perspective view of the folding rigid arm of FIG. 16A in a retracted position, according to an embodiment.
Figure 16C:
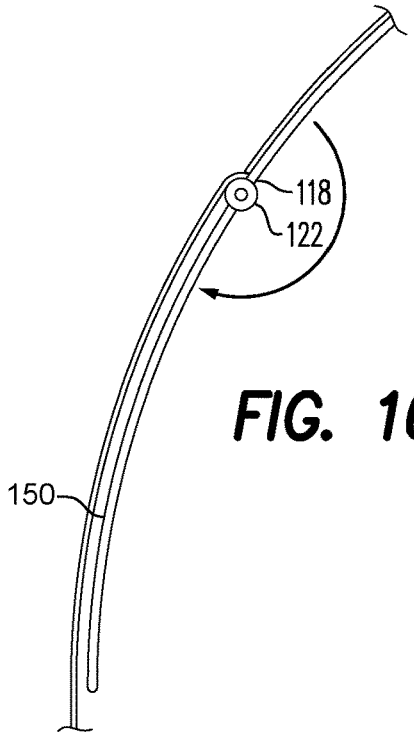
FIG. 16C is a perspective view of the folding rigid arm of FIG. 16A in an extended position, according to an embodiment.

FIGS. 16A-16C and FIGS. 17A-17C illustrate an alternate embodiment of the protective device 300. The protective device 300 includes an umbrella 50 having a canopy 51, and a protective member 30 positioned over the canopy 51 (FIGS. 17A-17C) or extending from or otherwise secured to the peripheral edge 54 of the canopy 51 (FIGS. 16A-16C). The umbrella 50 and protective member 30 may be configured substantially as described hereinabove and illustrated in FIGS. 2 to 12, and FIGS. 14A-15C, thus for purposes of convenience and not limitation, similar aspects, features and functionality are not repeated in detail hereinbelow.

Figure 17A:
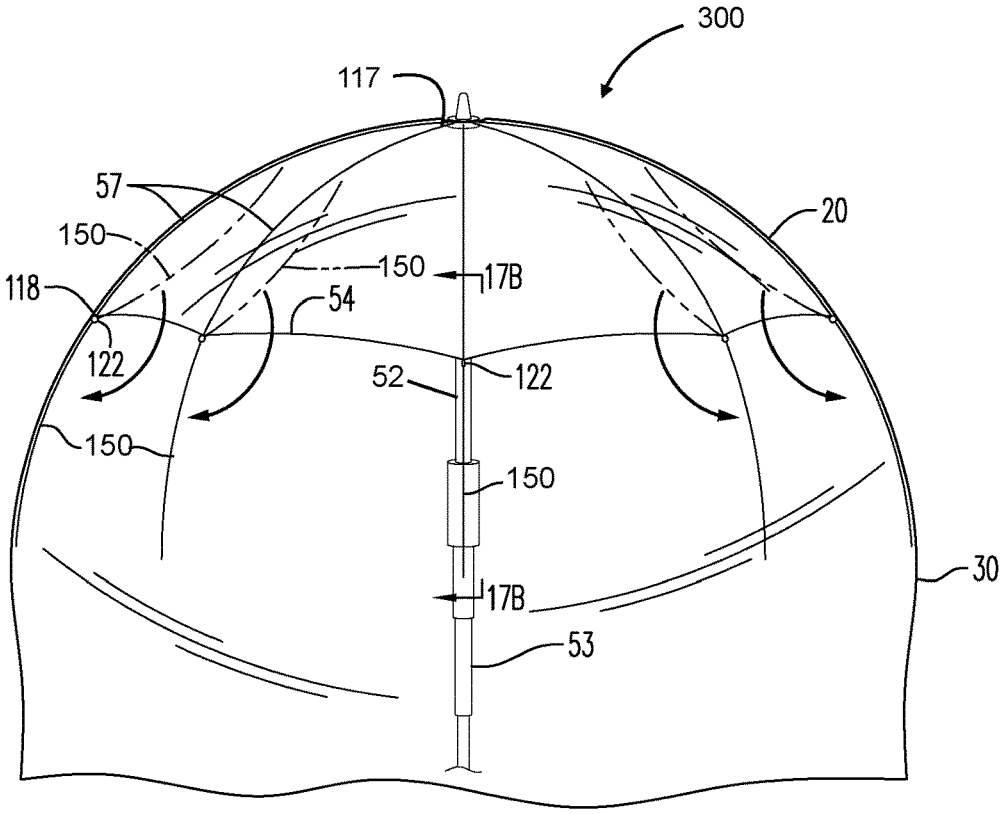
FIG. 17A is a perspective view of a protective device including a folding rigid arm, according to an embodiment.
Figure 17B:
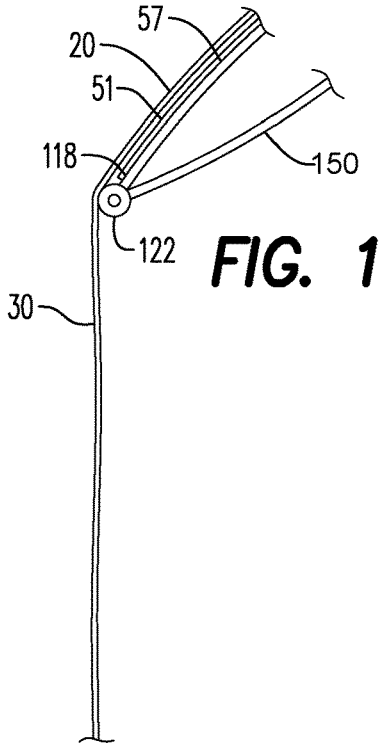
FIG. 17B is a perspective view of the folding rigid arm of FIG. 17A in a retracted position, according to an embodiment.
Figure 17C:
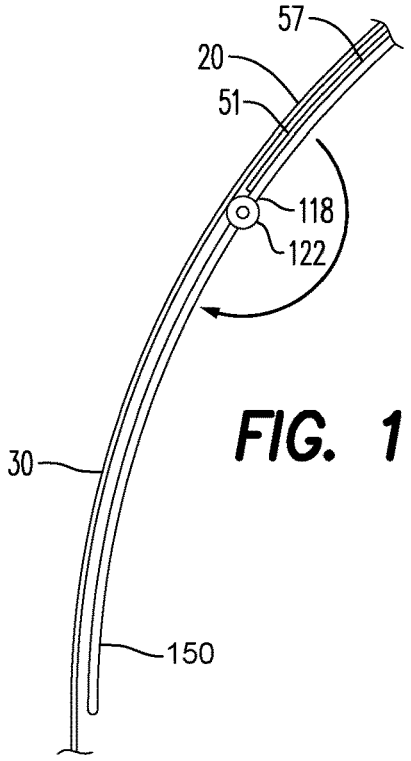
FIG. 17C is a perspective view of the folding rigid arm of FIG. 17A in an extended position, according to an embodiment.

The umbrella spine 57 of the protective member illustrated in FIG. 16A and FIG. 17A may include a folding rigid arm 150 hingedly connected to the distal end 118 of the spine 57. According to an aspect, the folding rigid arm 150 is connected to the spine 57 at a hinged connection point 122. The folding rigid arm 150 is configured for moving between a collapsed position (FIG. 16B and FIG. 17B) and an extended position (FIG. 16C and FIG. 17C) about the hinged connection point 122. The protective member 30 extends from a peripheral edge 54 of the canopy 51 (FIGS. 17A-17C) or covers the canopy 51 (FIGS. 16A-16C), such that the folding rigid arm 150 of each umbrella spine 57 supports the protective member 30 in the extended position. In other words, the protective member 30 is in contact with the rigid arm 150 when the rigid arm 150 is in the extended position such that the protective member 30 is urged radially away from the centrally positioned shaft 52. According to an aspect, a radial cross-section of the protective member 30 below the peripheral edge 54 has a greater diameter than the diameter of the peripheral edge.

Figure 18:
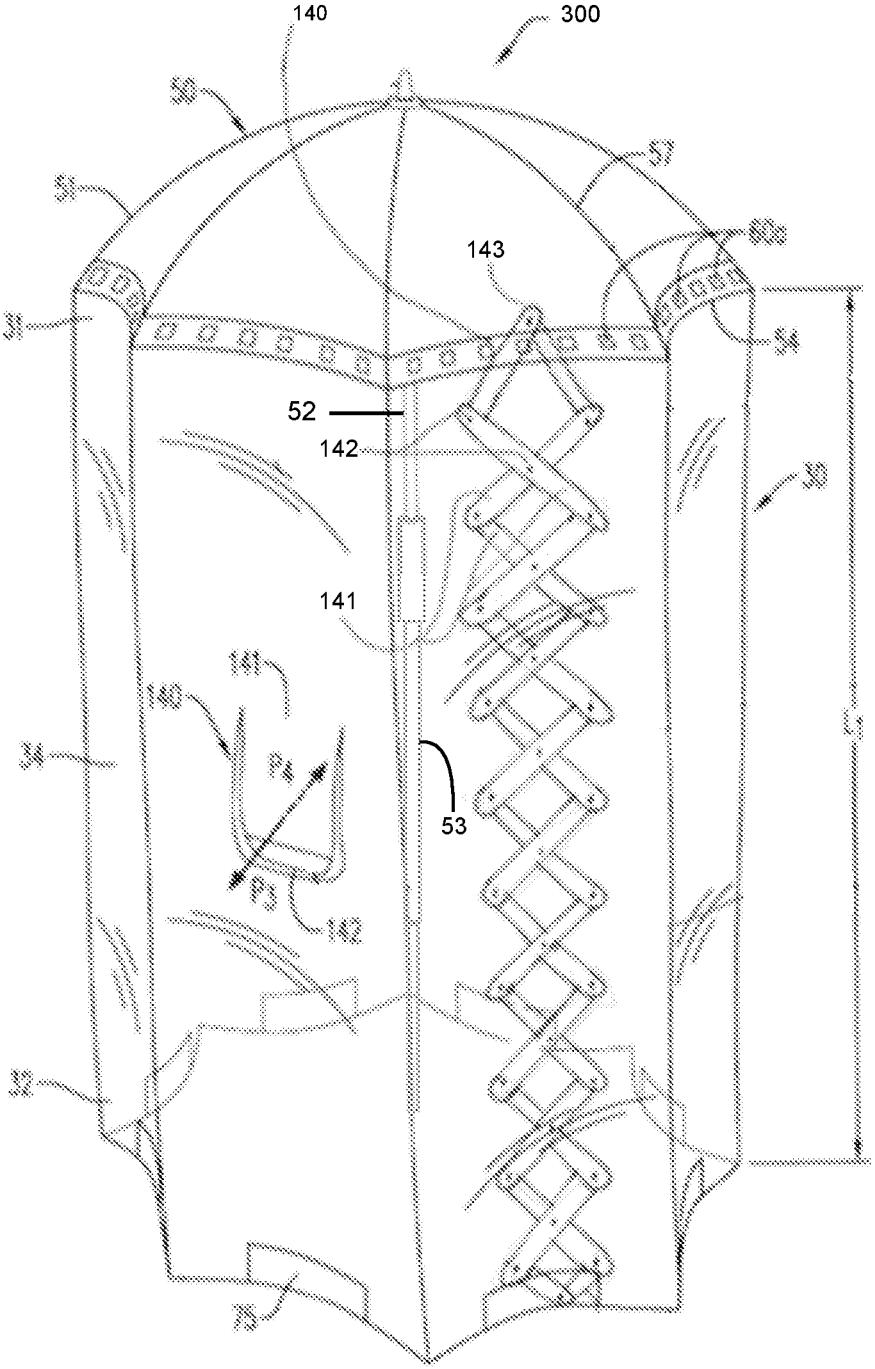
FIG. 18 is a perspective view of a protective device including a scissor arm assembly, according to an embodiment.

FIG. 18 illustrates an additional embodiment of the protective device 300. The protective device illustrated in FIG. 18 includes an umbrella 50 having a canopy 51, and a protective member 30 extending from the peripheral edge 54 of the canopy 51. It is contemplated that in alternate embodiments, the protective member 30 may otherwise be secured to the peripheral edge 54 of the canopy 51, or the protective member 30 may be positioned over the canopy 51. The umbrella 50 and protective member 30 may be configured substantially as described hereinabove and illustrated in FIGS. 2 to 17, thus for purposes of convenience and not limitation, similar aspects, features and functionality are not repeated in detail hereinbelow.

The protective device 300 includes a scissor arm assembly 140. The scissor arm assembly 140 includes a first end 143 positioned adjacent the canopy 51 and a second end 144 substantially adjacent the second end 32 of the protective member 30. According to an aspect, the scissor arm assembly 140 includes two or more scissor arms 141 pivotably connected about one or more pivot points 142. Each arm 141 of the scissor arms 141 moves in an axial direction to extend and collapse about the pivot point 142 in a direction substantially parallel to the centrally positioned shaft 52. According to an aspect, the scissor arm assembly 140 moves the protective member 30 between a substantially vertical/extended position and a substantially retracted position. FIG. 18 illustrates the scissor arm assembly 140 and the protective member 30 both in the extended position. According to an aspect, the scissor arm assembly 140 may be coupled to one or more points on the protective member 30, such as, for example, the second end 32 of the protective member 30. When in the extended or retracted position, the scissor arm assembly 140 may retain the protective member 30 in the selected position using a releasing element and a locking mechanism.

The components of the apparatus illustrated are not limited to the specific embodiments described herein, but rather, features illustrated or described as part of one embodiment can be used on or in conjunction with other embodiments to yield yet a further embodiment. It is intended that the apparatus include such modifications and variations. Further, steps described in the method may be utilized independently and separately from other steps described herein.

While the apparatus and method have been described with reference to specific embodiments, it will be understood by those skilled in the art that various changes may be made and equivalents may be substituted for elements thereof without departing from the scope contemplated. In addition, many modifications may be made to adapt a particular situation or material to the teachings found herein without departing from the essential scope thereof.

In this specification and the claims that follow, reference will be made to a number of terms that have the following meanings. The singular forms "a," "an" and "the" include plural referents unless the context clearly dictates otherwise. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A protective device configured for providing a user with body protection, the protective device comprising:

an umbrella having a canopy and a centrally positioned shaft extending from a center of the canopy, the centrally positioned shaft including a telescopic stem configured to support the protective device when configured in an extended position;

an umbrella spine extending from the centrally positioned shaft in a radial direction from the center of the canopy, the umbrella spine having a proximate end originating adjacent the centrally positioned shaft and a distal end spaced apart from and opposite the proximate end, the distal end housing a telescoping rigid segment configured for radial extension from the distal end; and a protective member positioned over the canopy and extending over the telescoping rigid segment, wherein the telescoping rigid segment is configured to support the protective member when the telescoping rigid segment is in a radially extended position, the telescoping rigid segment having a proximal end coupled to the distal end of the umbrella spine and a distal end, the telescoping rigid segment having an outer-facing surface extending between the proximal end and the distal end of the telescoping rigid segment, the outer-facing surface being configured to engage an inner-facing surface of the protective member when the telescoping rigid segment is in the radially extended position, wherein the umbrella spine and the telescoping rigid segment are arcuate along a length thereof.

2. The protective device of claim 1, wherein the centrally positioned shaft comprises a first end spaced apart from the telescoping stem, wherein the protective member is secured to the first end of the centrally positioned shaft.

3. The protective device of claim 2, wherein the first end of the shaft extends through an opening formed in the protective member.

4. The protective device of claim 2, wherein the protective member comprises an attachment member configured to secure the protective member to the first end of the shaft.

5. The protective device of claim 4, wherein the attachment member comprises an elastic portion configured to cinch and elastically engage the first end of the shaft.

6. The protective device of claim 1, wherein the telescoping rigid segment comprises a tubular segment configured to be slidably received within the umbrella spine.

7. The protective device of claim 1, wherein the telescoping rigid segment is one of a plurality of telescoping rigid segments and the umbrella spine is one of a plurality of umbrella spines, wherein each telescoping rigid segment of the plurality of telescoping rigid segments is slidably received within a respective umbrella spine of the plurality of umbrella spines.

8. The protective device of claim 7, wherein the plurality of telescoping rigid segments is configured to move radially and vertically as a unit.

9. The protective device of claim 8, further comprising an adjustment mechanism configured to raise, lower or fix the plurality of telescoping rigid segments in position.

10. The protective device of claim 9, wherein the adjustment mechanism comprises:

a locking mechanism; and a release mechanism.

11. The protective device of claim 7, wherein the protective member comprises:

an upper end; and a lower end, wherein the plurality of telescoping rigid segments is configured to extend to a position between the upper end and the lower end of the protective member.

12. The protective device of claim 1, wherein the protective member is composed of an impervious waterproof material, and at least a lower portion of the protective member is substantially transparent.

13. A protective device configured for providing a user with body protection, the protective device comprising:

an umbrella having a canopy and a shaft extending from a center of the canopy;

an umbrella spine extending from the shaft in a radial direction from the center of the canopy, the umbrella spine having a proximate end originating adjacent the shaft and a distal end spaced apart from and opposite the proximate end;

a telescoping rigid segment configured for extension from the distal end of the umbrella spine; and a protective member extending from a peripheral edge of the canopy, wherein the rigid segment is configured to support the protective member when the telescoping rigid segment is in an extended position, the telescoping rigid segment having a proximal end coupled to the distal end of the umbrella spine and a distal end, the telescoping rigid segment having an outer-facing surface extending between the proximal end and the distal end of the telescoping rigid segment, the outer-facing surface being configured to engage an inner-facing surface of the protective member when the telescoping rigid segment is in the extended position, wherein the umbrella spine and the telescoping rigid segment are arcuate along a length thereof.

14. The protective device of claim 13, wherein the canopy comprises a canopy window having a first border and a second border, the second border being configured to be moveable from a closed border position to an open border position, and the canopy window being configured for at least one of observation or admittance of light and air therethrough.

15. The protective device of claim 13, wherein the protective member comprises an attachment member configured to secure the protective member to a peripheral edge of the canopy.

16. The protective device of claim 13, wherein the telescoping rigid segment comprises a tubular segment configured to be slidable slidably received within the umbrella spine.

17. The protective device of claim 13, wherein the telescoping rigid segment is one of a plurality of telescoping rigid segments and the umbrella spine is one of a plurality of umbrella spines, wherein each telescoping rigid segment of the plurality of telescoping rigid segments is slidably received within a respective umbrella spine of the plurality of umbrella spines.

18. The protective device of claim 17, wherein the plurality of telescoping rigid segments is configured to move radially and vertically as a unit.

19. The protective device of claim 18, further comprising an adjustment mechanism configured to raise, lower or fix the plurality of telescoping rigid segments in position, wherein the adjustment mechanism comprises:

a locking mechanism; and a release mechanism.

* * * * *